US008500356B2

(12) United States Patent
Tanaka et al.

(10) Patent No.: US 8,500,356 B2
(45) Date of Patent: Aug. 6, 2013

(54) BINDING DEVICE

(75) Inventors: Kanji Tanaka, Osaka (JP); Yoshiteru Arimoto, Osaka (JP); Mitsunori Maeda, Osaka (JP)

(73) Assignee: Lihit Lab., Inc., Osaka (JP)

( * ) Notice: Subject to any disclaimer, the term of this patent is extended or adjusted under 35 U.S.C. 154(b) by 504 days.

(21) Appl. No.: 12/746,295

(22) PCT Filed: Sep. 7, 2009

(86) PCT No.: PCT/JP2009/065564

§ 371 (c)(1),
(2), (4) Date: Jun. 4, 2010

(87) PCT Pub. No.: WO2010/047184

PCT Pub. Date: Apr. 29, 2010

(65) Prior Publication Data

US 2010/0278584 A1 Nov. 4, 2010

(30) Foreign Application Priority Data

Oct. 21, 2008 (JP) ..... 2008-271299
Jan. 7, 2009 (JP) ..... 2009-001974

(51) Int. Cl.
*B42F 13/22* (2006.01)

(52) U.S. Cl.
USPC ..... 402/42

(58) Field of Classification Search
USPC ..... 402/30–32, 42, 34–35, 55–56
See application file for complete search history.

(56) References Cited

U.S. PATENT DOCUMENTS

| | | | | | |
|---|---|---|---|---|---|
| 2,206,317 | A * | 7/1940 | Behn | 402/43 |
| 2,268,431 | A * | 12/1941 | Slonneger | 402/43 |
| 2,331,461 | A * | 10/1943 | Dawson et al. | 402/42 |
| 2,715,906 | A * | 8/1955 | Lucchesi | 402/20 |
| 4,904,103 | A * | 2/1990 | Im | 402/35 |
| 6,196,749 | B1 * | 3/2001 | Chizmar | 402/42 |
| 2008/0170905 | A1 * | 7/2008 | Cheng | 402/19 |
| 2008/0310909 | A1 * | 12/2008 | Park | 402/34 |

FOREIGN PATENT DOCUMENTS

| | | |
|---|---|---|
| JP | 39-14807 Y1 | 6/1964 |
| JP | 7-17578 | 3/1995 |
| JP | 09-086088 A | 3/1997 |
| JP | 2001-315481 | 11/2001 |
| JP | 2005-040952 A | 2/2005 |

* cited by examiner

*Primary Examiner* — Dana Ross
*Assistant Examiner* — Leonel Vasquez
(74) *Attorney, Agent, or Firm* — Rabin & Berdo, P.C.

(57) ABSTRACT

A binding device includes binding rod portions, coupling portions for coupling a plurality of the binding rod portions, and an axis portion serving as a center upon opening/closing of binding rods. The coupling portions have lower portions to which the axis portion is provided at a position close to base portions of the binding rods so that a leaf bound at the binding rod portions can be flipped along the binding rods and flipped through 360 degrees and leaves can make contact with each other with the axis portion sandwiched therebetween. The axis portion includes a shaft portion and receiving portions for the shaft portion. The receiving portions are provided to the coupling portions the shaft portion is disposed therein.

6 Claims, 20 Drawing Sheets

A-A cross-sectional view

B-B cross-sectional view

A-A cross-sectional view

B-B cross-sectional view (A)

(B)

(C)

(A)

(B)

BINDING DEVICE

BACKGROUND OF THE INVENTION

The present invention relates to a binding device for filing, and in particular to a binding device used as, for example, a plastic ring type notebook or a file, a binder, or the like for binding a leaf with binding holes.

Conventionally, a notebook that binds a leaf with holes by using a ring-shaped member can, along its ring shape, spread the leaf through 360 degrees, in other words, not only open the leaf but also flip over the leaf to lay its front side and its reverse side on each other, thus utilizing half a space utilized by a notebook openable through only 180 degrees. However, the plastic ring type notebook has a disadvantage that it does not permit leaf replacement.

On the other hand, a notebook with binding devices of Japanese Patent No. 3440356 and Japanese Utility Model Application Laid-Open Publication No. H7-17578, in other words, a notebook with openable/closable binding rod portions that bind a leaf permits leaf replacement.

Patent Document 1: Japanese Patent No. 3440356

Patent Document 2: Japanese Utility Model Application Laid-Open Publication No. H7-17578

However, the binding device of Japanese Patent No. 3440356 is a binding device composed of two main members (1) having a plurality of comb portions (2), wherein a slidable ring member (4) is provided at an end of the main member (1*a*) and inside of this ring member (4) has almost the same shape as or a slightly smaller shape than an outer shape obtained by integrating the main member (1*a*) and the main member (1*b*). For the leaf replacement, this binding device, upon fitting of fitting means provided at tips of the plurality of the comb portions after separating the two main members from each other, requires relatively many man-hours for fitting the many comb portions.

Moreover, the binding device of Japanese Utility Model Application Laid-Open Publication No. H7-17578 has a first member and a second member with a plurality of uprising binding loops, pivotably fitted together by a common axis line. Therefore, although the first member and the second member do not separate from each other, a bar-type coupling portion for coupling the plurality of binding loops is formed at base portions of the binding loops 15 and 17, and a protruding portion 23 is provided in such a manner as to project from an inner side surface of this coupling portion. Accordingly, for example, even upon attempt to place the binding device on a desk to open it, outsides of the base portions of the binding loops hit a desk surface and thus the binding loops are not fully opened, thus making it relatively difficult to take-in and take-out the leaf. Additionally, integral molding with synthetic resin is difficult since it results in a complicated structure of a manufacturing die.

Therefore, it is a main object of the present invention to provide a binding device easily manufactured and having binding rods easily opened and closed for easy leaf replacement.

SUMMARY OF THE INVENTION

A binding device according to the present invention is a binding device including: a plurality of binding rod portions; coupling portions for coupling the binding rod portions; and an axis portion serving as a center upon opening/closing of binding rods composing the binding rod portions, in which: the binding rods composing the binding rod portions are respectively provided at pairs of coupling portions composing the coupling portions at appropriate intervals in a longitudinal direction thereof in such a manner as to project from outer portions or upper portions of the coupling portions so that pairs of the binding rods face each other; the coupling portions have lower portions to which the axis portion is provided continuously at a position close to base portions of the binding rods in such a manner that when the leaf bound at the binding rod portions is flipped along the binding rods and flipped over through 360 degrees for closing, a front side and a reverse side of the leaf located at both ends can make contact with each other with the axis portion sandwiched therebetween; the axis portion includes a shaft portion and receiving portions for the shaft portion; the shaft portion extends in the longitudinal direction of the coupling portions to couple the pairs of coupling portions; the receiving portions are provided continuously to the binding rod portions and/or the coupling portions, and have aperture portions formed on side surfaces thereof for filling the shaft portion therein; and the axis portion is configured in such a manner as to serve as a rotation center upon closing with tips of the binding rods brought into contact with each other and upon separation of the tips of the binding rods from each other so that the leaf bound at the binding portions can be flipped along the binding rods and then flipped over through 360 degrees.

In an aspect of the invention the coupling portions include a first coupling portion and a second coupling portion in a form separated to left and right with respect to the axis portion as a center; the first receiving portions on a first coupling portion side have housing portions intermittently formed between the adjacent receiving portions when the shaft portion is filled; the second receiving portions on a second coupling portion side have housing portions intermittently formed between the adjacent receiving portions when the shaft portion is filled; and the second receiving portions housed by the housing portions on a first receiving portion side and the first receiving portions housed by the housing portions on a second receiving portion side are aligned at appropriate space therebetween on an axis line of the axis portion when the first binding rods and the second binding rods are closed, and also slidably mounted at the shaft portion in such a manner that the first binding rods and the second binding rods relatively move upon opening/closing of the first binding rods and the second binding rods.

In an aspect of the invention, a spring member applies tensile or compressive force in a longitudinal direction of the shaft portion and is fitted in a compressed state between one of the first housing portions and one of the second receiving portions or between one of the second housing portions and one of the first receiving portions.

In an aspect of the invention the binding rod portions have, at free ends on a side opposite to base portions of the binding rods provided continuously to the coupling portions, binding rod latching portions formed for latching the binding rods when the binding rods are closed; and the binding rod latching portions are formed in such a manner as to be latched or disengaged by relatively moving the binding rods, which are to be latched, in a direction crossing turning directions of the binding rods to be latched.

In an aspect of the invention the coupling portions have aperture angle restricting portions formed on side surfaces thereof for restricting an aperture angle of the binding rods at an angle which permits easy insertion of the leaf.

According to the present invention, a binding device includes: a plurality of binding rod portions; coupling portions for coupling the binding rod portions; and an axis portion serving as a center upon opening/closing of binding rods composing the binding rod portions, in which: the binding rods composing the binding rod portions are respectively provided at pairs of coupling portions composing the coupling portions at appropriate intervals in a longitudinal direction thereof in such a manner as to project from outer portions or upper portions of the coupling portions so that pairs of the binding rods face each other; the coupling portions have lower portions to which the axis portion is provided continuously at a position close to base portions of the binding rods in such a manner that when the leaf bound at the binding rod portions is flipped along the binding rods and flipped over through 360 degrees for closing, a front side and a reverse side of the leaf located at both ends can make contact with each other with the axis portion sandwiched therebetween; the axis portion includes a shaft portion and receiving portions for the shaft portion; the shaft portion extends in the longitudinal direction of the coupling portions to couple the pairs of coupling portions; the receiving portions are provided continuously to the binding rod portions and/or the coupling portions, and have aperture portions formed on side surfaces thereof for filling the shaft portion therein; and the receiving portions are configured in such a manner as to serve as a rotation center upon closing with tips of the binding rods brought into contact with each other and upon separation of the tips of the binding rods from each other so that the leaf bound at the binding portions can be flipped along the binding rods and then flipped over through 360 degrees. Therefore, a binding device easily manufactured and having binding rods easily opened and closed for easy leaf replacement can be provided.

In an aspect of the invention, the coupling portions include a first coupling portion and a second coupling portion in a form separated to left and right with respect to the axis portion as a center, the first receiving portions on a first coupling portion side have housing portions intermittently formed between the adjacent receiving portions when the shaft portion is filled, the second receiving portions on a second coupling portion side have housing portions intermittently formed between the adjacent receiving portions when the shaft portion is filled, and the second receiving portions housed by the housing portions on a first receiving portion side and the first receiving portions housed by the housing portions on a second receiving portion side are aligned at appropriate space therebetween on an axis line of the axis portion when the first binding rods and the second binding rods are closed, and also slidably mounted at the shaft portion in such a manner that the first binding rods and the second binding rods relatively move upon opening/closing of the first binding rods and the second binding rods. Therefore, the binding rod portions composed of the plurality of binding rods can be opened/closed at one time.

In an aspect of the invention, a spring member applies tensile or compressive force in a longitudinal direction of the shaft portion and is fitted in a compressed state between one of the first housing portions and one of the second receiving portions or between one of the second housing portions and one of the first receiving portions.

In another aspect of the invention, the binding rod portions have, at free ends on a side opposite to base portions of the binding rods provided continuously to the coupling portions, binding rod latching portions formed for latching the binding rods when the binding rods are closed, and the binding rod latching portions are formed in such a manner as to be latched or disengaged by relatively moving the binding rods, which are to be latched, in a direction crossing turning directions of the binding rods to be latched. Therefore, upon opening/closing the binding rods, the binding rods can be relatively moved in the direction crossing the turning directions of the binding rods to be latched, and thus can be opened/closed at once.

In another aspect of the invention, the coupling portions have aperture angle restricting portions formed on side surfaces thereof for restricting an aperture angle of the binding rods at an angle which permits easy insertion of the leaf. Therefore, the binding rods can be set at an optimum angle, for example, an optimum angle in leaf take-in and take-out.

The aforementioned object, other objects, features and advantages of the present invention will be more clarified from description of best modes for carrying out the invention provided below with reference to the drawings.

In this specification and a scope of claims, the leaf is a general term of bound objects, such as a sheet, a pocket of synthetic resin, a front cover, and the like.

DETAILED DESCRIPTION OF THE INVENTION

Figure 1:
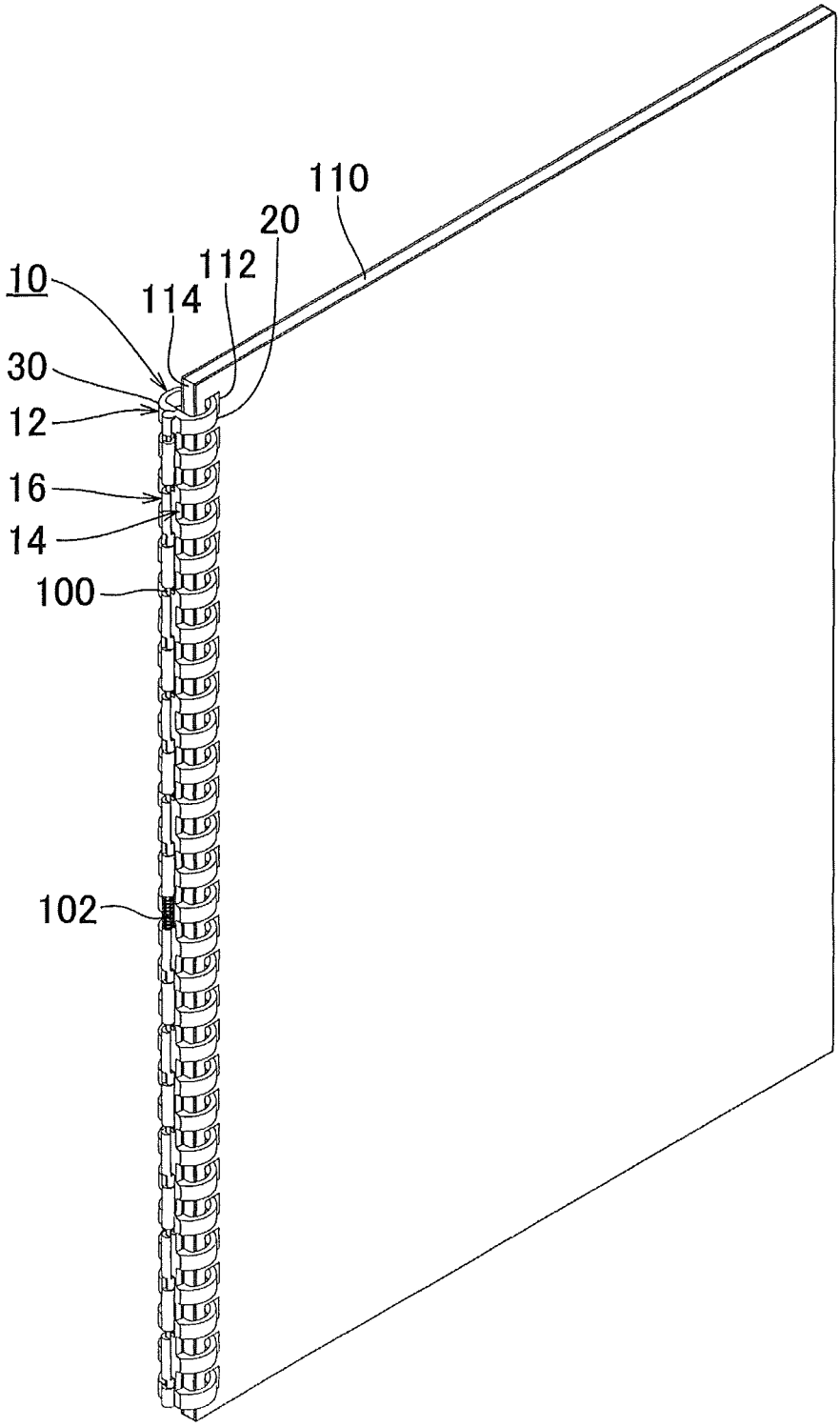
FIG. 1 is a schematic perspective view of a notebook with a binding device according to the present invention.
Figure 2:
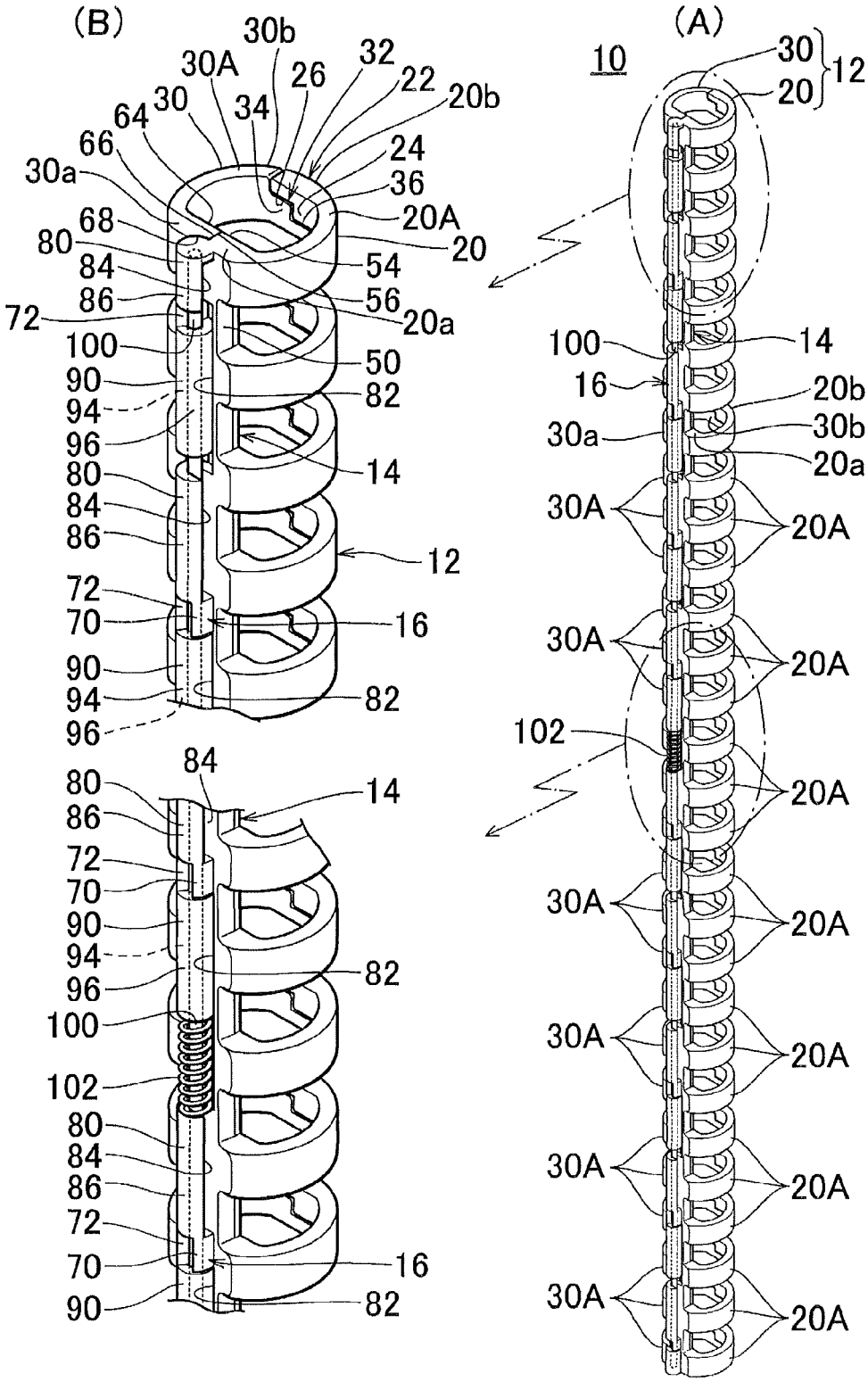
FIG. 2 is a schematic perspective view of the binding device according to the present invention, where (A) is an overall view and (B) is a partially enlarged view.
Figure 3:
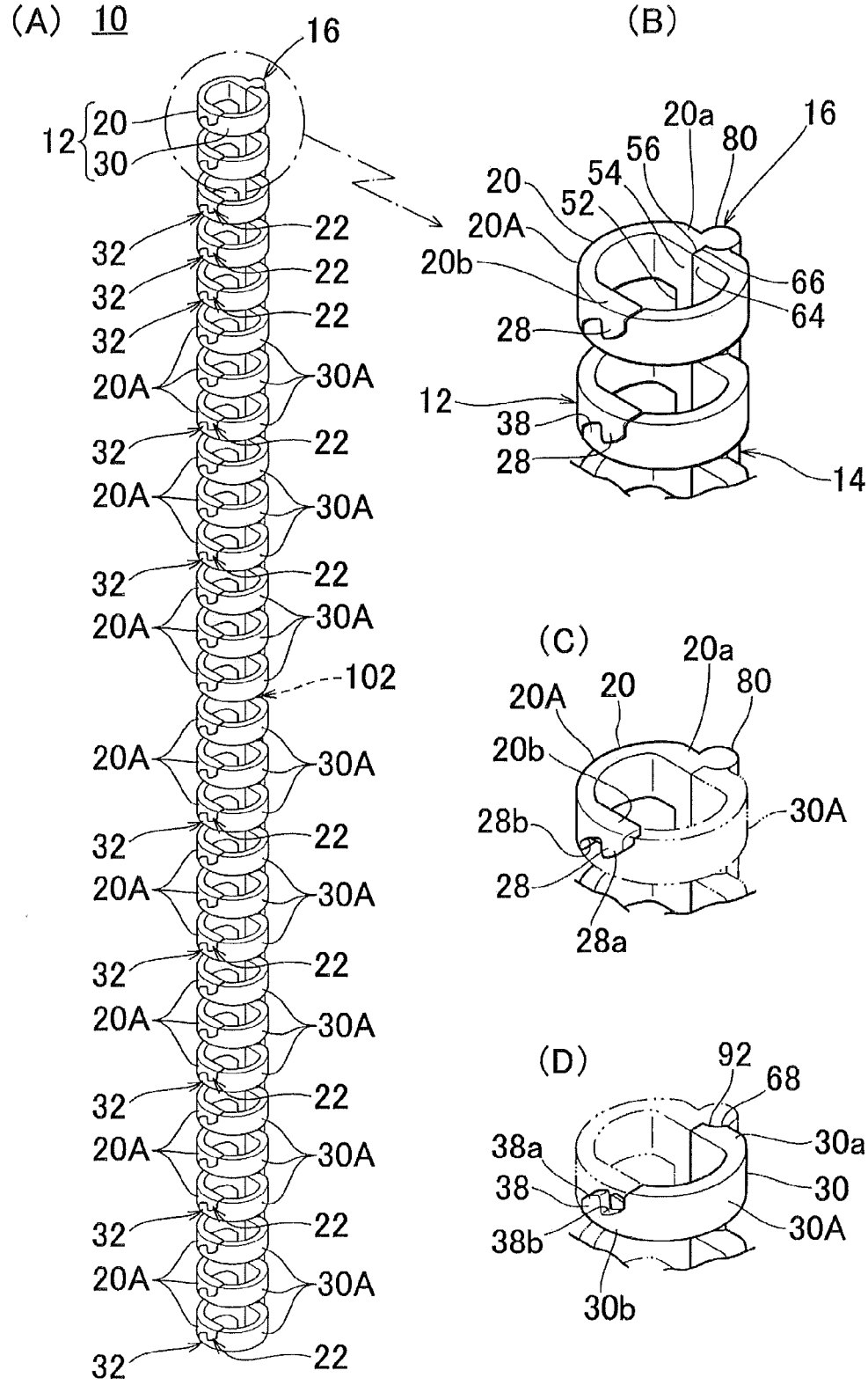
FIG. 3 is a schematic perspective view of the binding device according to the present invention, where (A) is an overall view, (B) is a partially enlarged view, and (C) and (D) are views of half rods.
Figure 4:
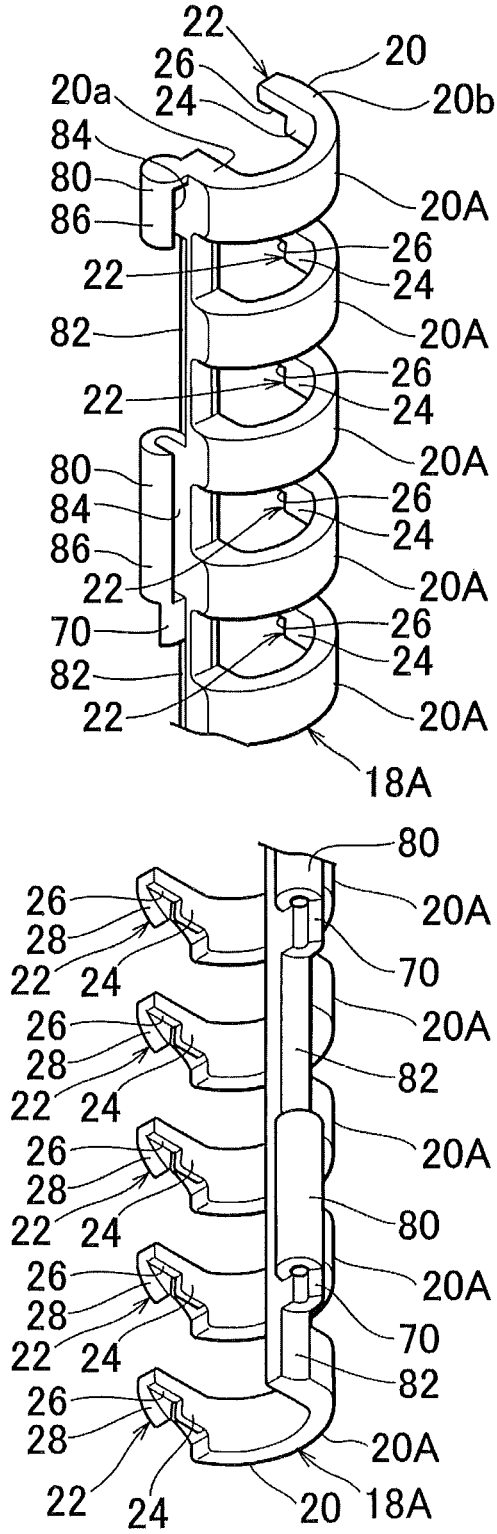
FIG. 4 is a schematic perspective view of a first binding device member.
Figure 5:
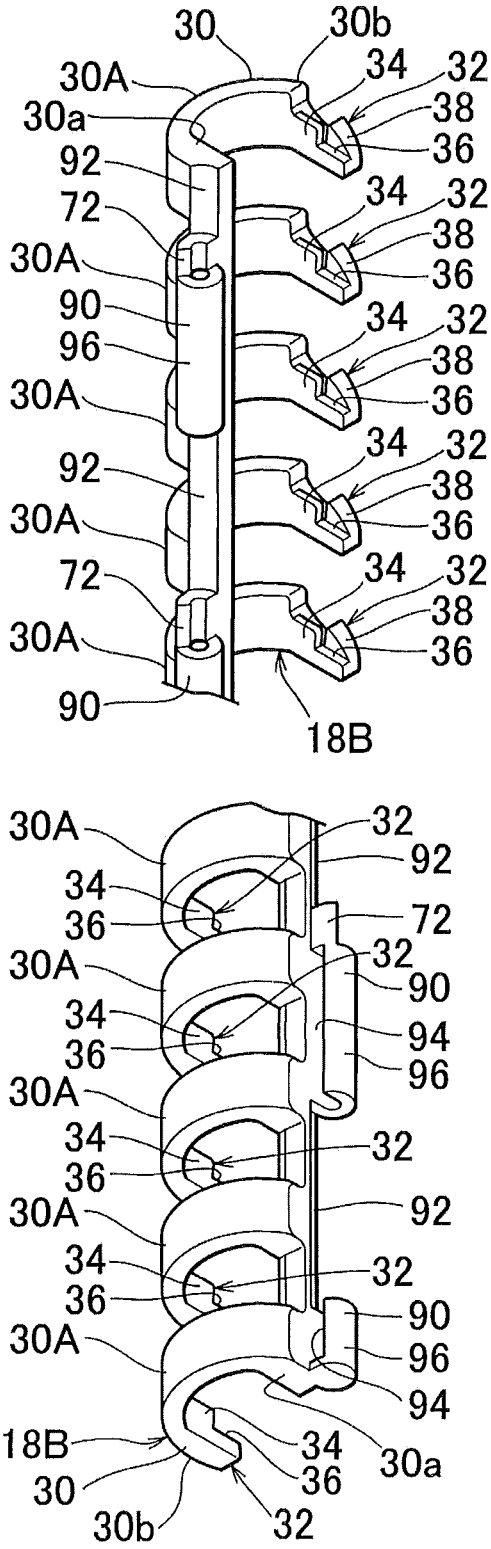
FIG. 5 is a schematic perspective view of a second binding device member.
Figure 6:
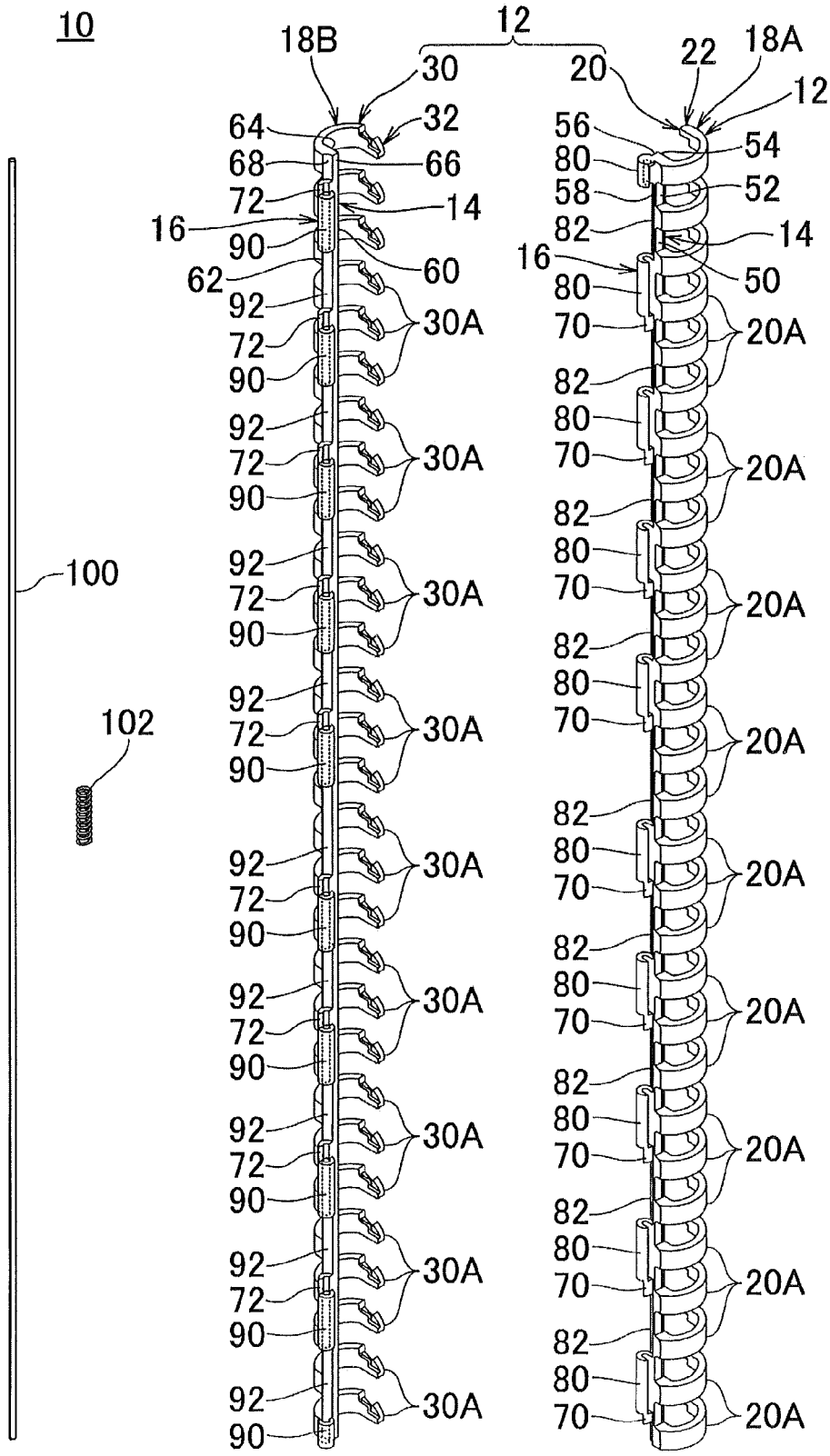
FIG. 6 is a schematic perspective view of the binding device according to the present invention in a disassembled state.
Figure 7:
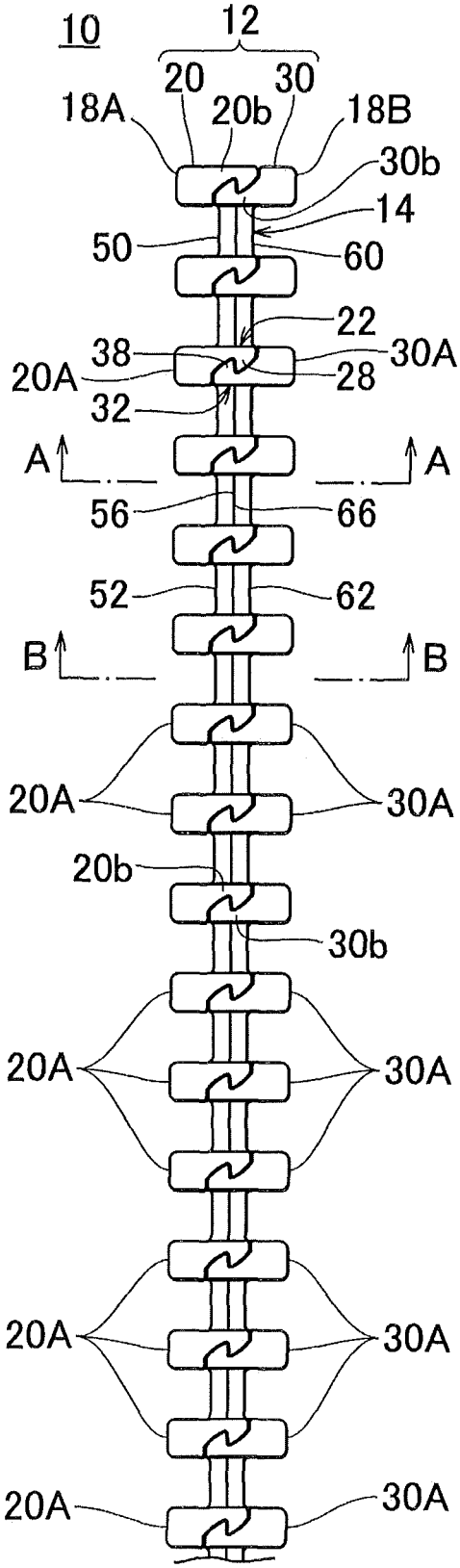
FIG. 7 is a schematic elevation view of the binding device in a closed state.
Figure 8:
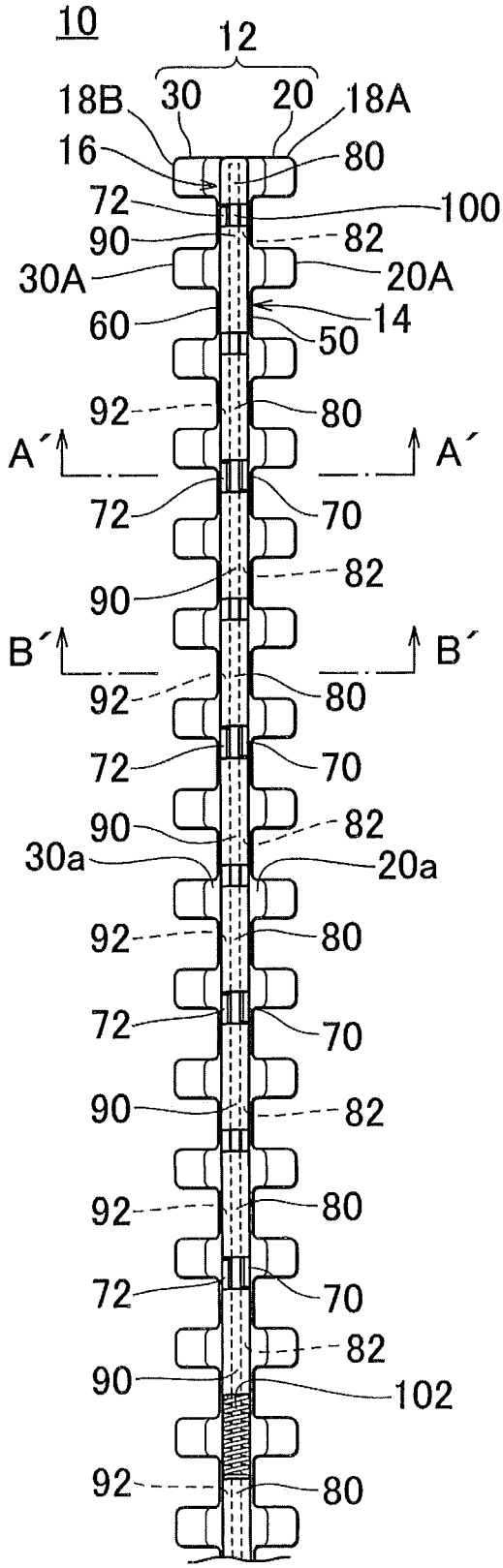
FIG. 8 is a schematic back view of the binding device in the closed state.
Figure 9:
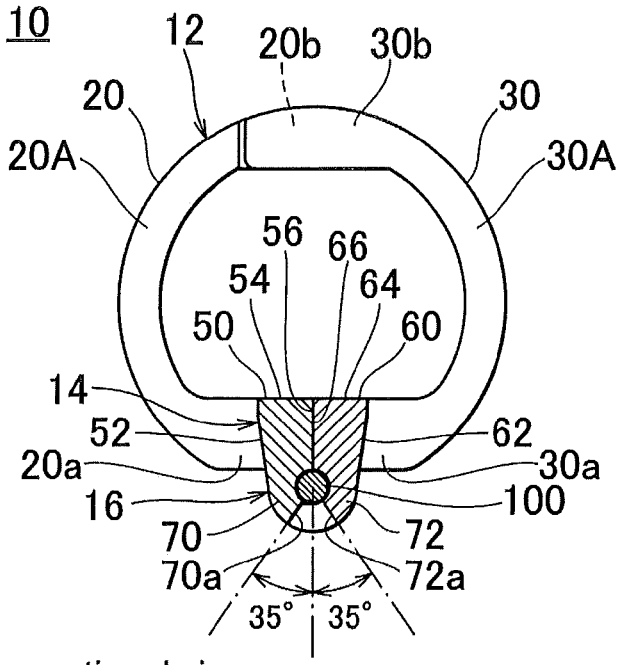
FIG. 9 is a schematic cross-sectional view taken along line A-A of FIG. 7.
Figure 10:
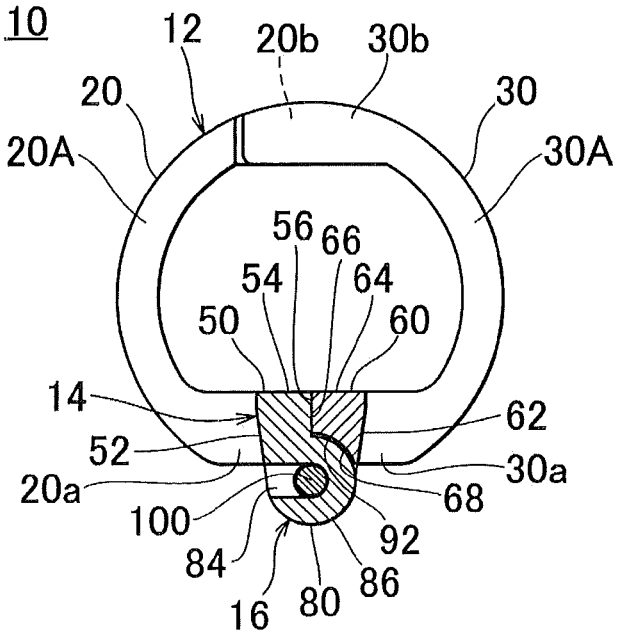
FIG. 10 is a schematic cross-sectional view taken along line B-B of FIG. 7.
Figure 11:
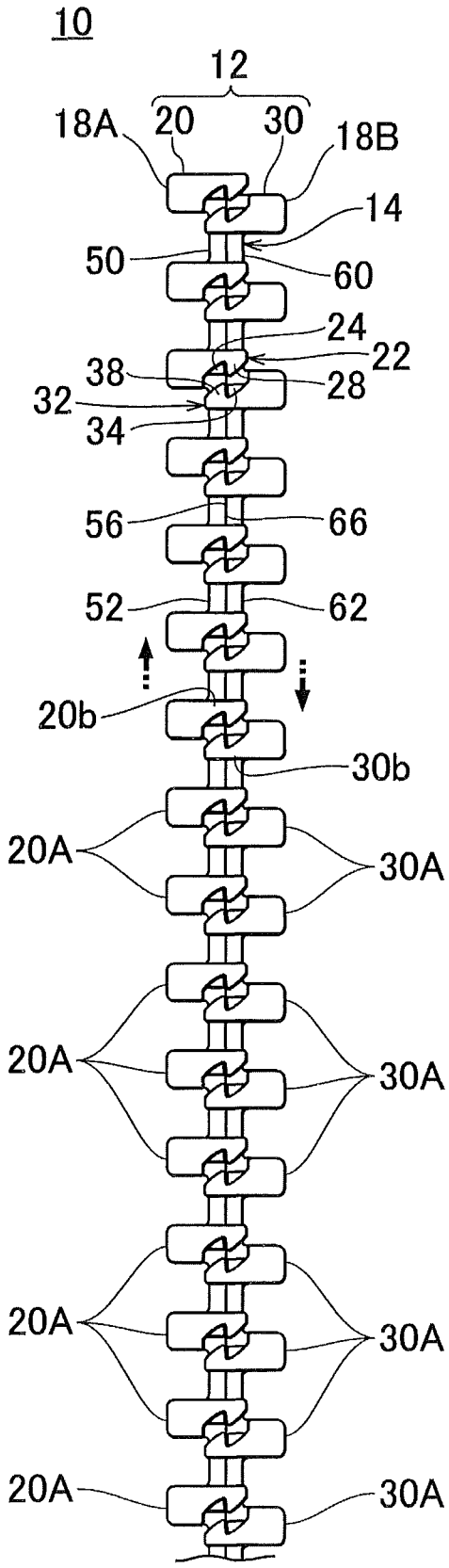
FIG. 11 is a schematic elevation view of the binding device in an opening start state.
Figure 12:
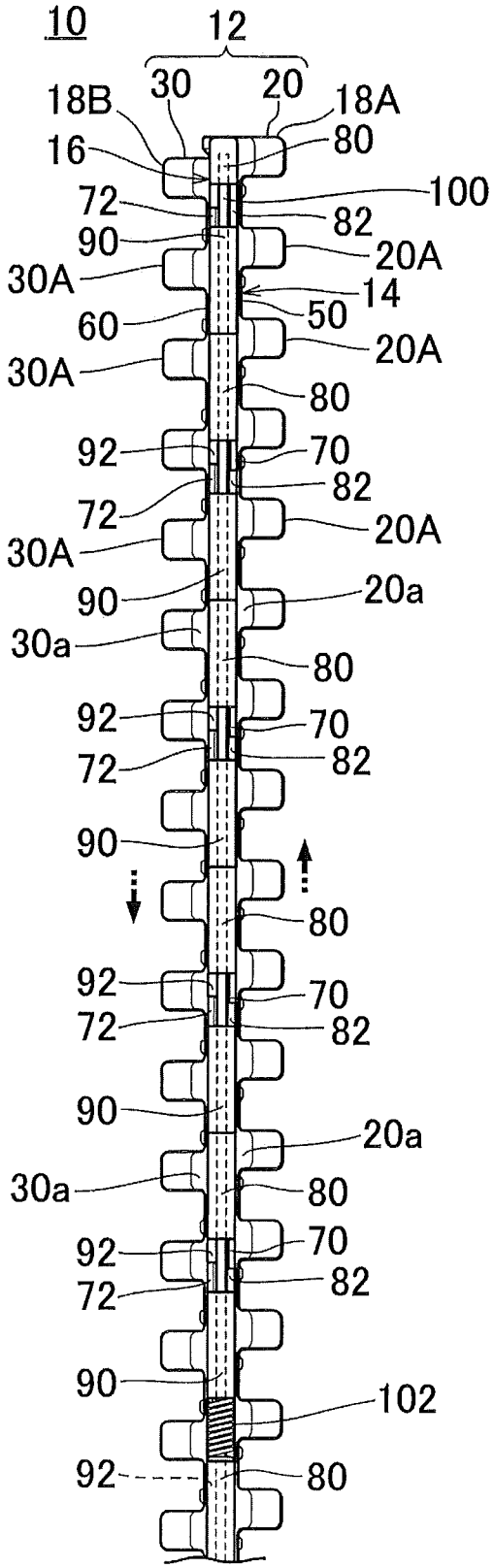
FIG. 12 is a schematic back view of the binding device in an opening start state.
Figure 13:
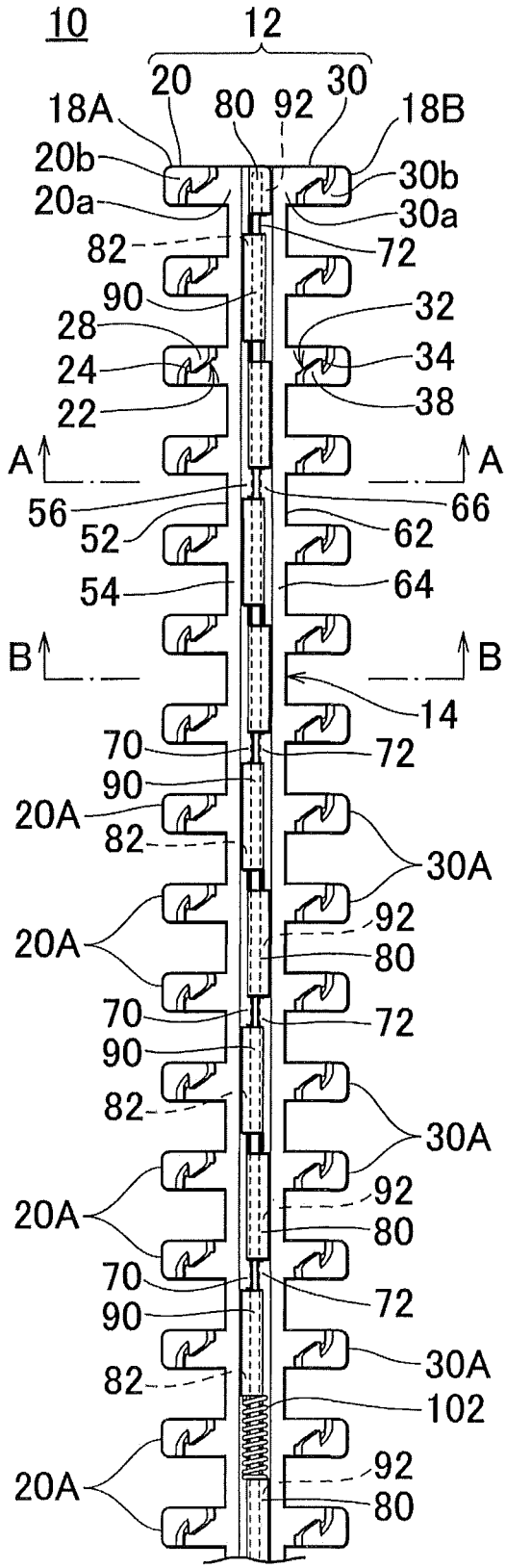
FIG. 13 is a schematic elevation view of the binding device in an opened state.
Figure 14:
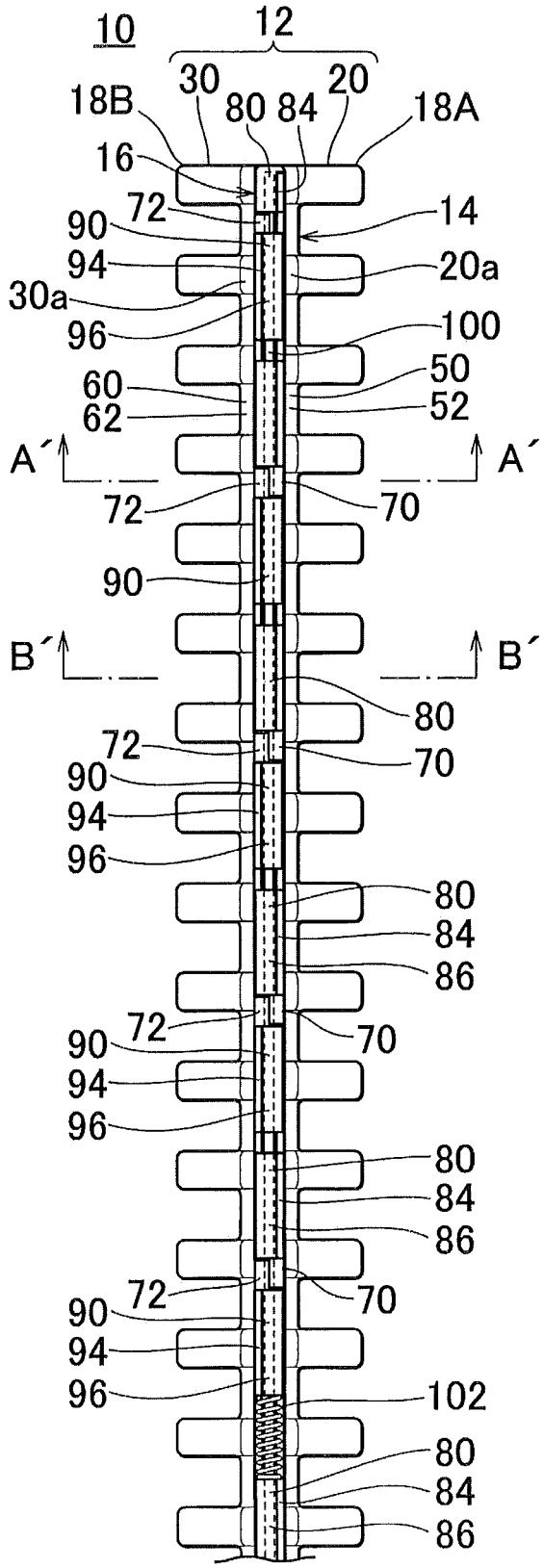
FIG. 14 is a schematic back view of the binding device in the opened state.
Figure 15:
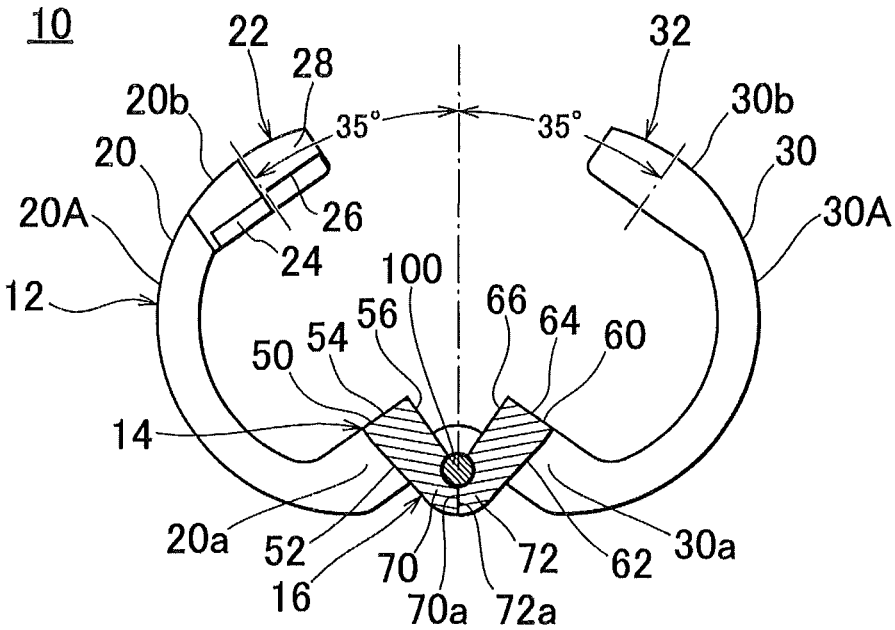
FIG. 15 is a schematic cross-sectional view taken along line A-A of FIG. 13.
Figure 16:
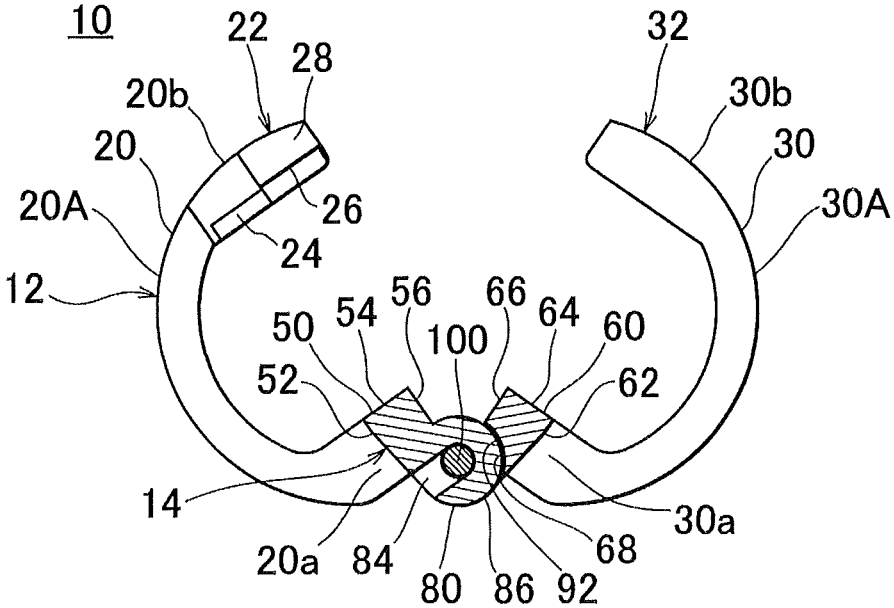
FIG. 16 is a schematic cross-sectional view taken along line B-B of FIG. 13.

FIG. 1 is a schematic perspective view of a notebook with a binding device according to the present invention, FIG. 2 is a schematic perspective view of the binding device according to the present invention, where (A) is an overall view and (B) is a partially enlarged view, FIG. 3 is schematic perspective view of the binding device according to the present invention, where (A) is an overall view, (B) is a partially enlarged view, and (C) and (D) are views of half rods, FIG. 4 is a schematic perspective view of a first binding device member, FIG. 5 is a schematic perspective view of a second binding device member, FIG. 6 is a schematic perspective view of the binding device according to the present invention in a disassembled state, FIG. 7 is a schematic elevation view of the binding device in a closed state, FIG. 8 is a schematic back view of the binding device in the closed state, FIG. 9 is a schematic cross-sectional view taken along line A-A of FIG. 7, FIG. 10 is a schematic cross-sectional view taken along line B-B of FIG. 7, FIG. 11 is a schematic elevation view of the binding device in an opening start state, FIG. 12 is a schematic back view of the binding device in the opening start state, FIG. 13 is a schematic elevation view of the binding device in an opened state, FIG. 14 is a schematic back view of the binding device in the opened state, FIG. 15 is a schematic cross-sectional view taken along line A-A of FIG. 13, and FIG. 16 is a schematic cross-sectional view taken along line B-B of FIG. 13.

A binding device 10 of the present invention includes: a plurality of binding rod portions 12, coupling portions 14 for coupling the binding rod portions 12, and an axis portion 16 serving as a center upon opening and closing of binding rods composing the binding rod portions 12. The binding device 10 is configured such that the closed binding rod portions 12 can be opened by twisting the binding rod portions 12.

This binding device 10 is mainly designed for a notebook similar to a notebook typically referred to as a plastic ring type notebook, and is configured so that a leaf 110 can be turned along the binding rod portions 12 of the binding device 10 to be spread through 360 degrees, in other words, when the leaf 110 bound at the binding rod portions 12 is flipped along the binding rods and flipped over through 360 degrees for closing, a front side and a reverse side of the leaf 110 located at both ends can make contact with each other with the axis portion 16 sandwiched therebetween.

Usually, on a front side and a reverse side of a writing sheet with binding holes, covers relatively harder than the aforementioned sheet are laid. In a scope of this specification and claims, the front side and the reverse side of the leaf 110 include a front side of a front cover on a front side of a sheet, a pocket of synthetic resin, or the like and a reverse side of a back cover on a reverse side thereof.

The binding rods composing the binding rod portions 12 are respectively provided at pairs of coupling portions 14 composing the coupling portions 14 at appropriate intervals in a longitudinal direction thereof in such a manner as to project from outer portions or upper portions of the coupling portions 14 so that pairs of the binding rods face each other. Each of the binding rod portions 12 includes the first binding rod 20 and the second binding rod 30 in a symmetric form separated to the left and right with respect to the axis portion 16 as a center.

The coupling portions 14 include a first coupling portion 50 and a second coupling portion 60 in a symmetric form separated to the left and right with respect to the axis portion 16 as a center. The first coupling portion 50 and the second coupling portion 60 are of a substantially columnar shape linearly extending in a longitudinal direction continuously from a far side to a near side.

In this embodiment, the first binding rods 20 and the first coupling portion 50 are formed at a first binding device member 18A, the second binding rods 30 and the second coupling portion 60 are formed at a second binding device member 18B, and the first binding device member 18A and the second binding device member 18B are formed symmetrically.

The first binding device member 118A is integrally molded with synthetic resin, and similarly, the second binding device member 18B is integrally molded with synthetic resin.

The coupling portions 14 have lower portions to which the axis portion 16 is provided continuously at a position close to base portions of the first binding rod 20 and the second binding rod 30 in such a manner that when the leaf 110 bound at the binding rod portions 12 is flipped along the first binding rods 20 and the second binding rods 30 and flipped over through 360 degrees for closing, the front side and the reverse side of the leaf 110 located at the both ends can make contact with each other with the axis portion 16 sandwiched therebetween.

The axis portion 16 extends in the longitudinal direction of the coupling portions 14 (the first coupling portion 50 and the second coupling portion 60) to couple the pair of the coupling portions 14 (the first coupling portion 50 and the second coupling portion 60), and is configured to serve as a rotation center upon closing with free ends 20*b* of the first binding rods 20 and free ends 30*b* of the second binding rods 30 brought into contact with each other and upon separation of the free ends 20*b* of the first binding rods 20 and the free ends 30*b* of the second binding rods 30 from each other so that the leaf 110 bound at the binding rod portions 12 can be flipped along the first binding rods 20 and the second binding rods 30 and flipped over through 360 degrees.

The binding rod portion 12 has, at the free end 20*b* and the free end 30*b* on a side opposite to the base portion 20*a* and the base portion 30*a* of the first binding rod 20 and the second binding rod 30 provided continuously to the coupling portions 14, binding rod latching portions formed for latching the first binding rod 20 and the second binding rod 30 when they are closed. In other words, the first binding rod 20 has the binding rod latching portion 22 of the first binding rod formed at the free end 20*b* as a top portion on the side opposite to the base portion 20*a*, and the second binding rod 30 has the binding rod latching portion 32 of the second binding rod formed at the free end 30*b* as a top portion on the side opposite to the base portion 30*a*.

The binding rod portion 12 includes a height direction (perpendicular direction) from the base portion 20*a* and the base portion 30*a* to the top portions and a width direction (horizontal direction) from an outer periphery portion (outer portion) of the first binding rod 20 to an outer periphery portion (outer portion) of the second binding rod 30. The binding rod portion 12 is of a cross-sectionally rectangular shape with a width of the first binding rod 20 and the second binding rod 30 in a longitudinal direction of the binding device, the width being longer than a thickness of the first binding rod 20 and the second binding rod 30 (a length between the outer periphery portions and inner periphery portions). Moreover, the first binding rod 20 and the second binding rod 30 are formed into a shape inserted through binding holes 112 of the leaf 110 from the base portion 20*a* and the base portion 30*a* to the top portions thereof so that the leaf 110 can be flipped.

The binding rod latching portion 22 of the first binding rod and the binding rod latching portion 32 of the second binding rod are formed in such a manner as to be latched upon closing with tips of the first binding rod 20 and the second binding rod 30 brought into contact with each other or disengaged upon separation of the tips of these first binding rod 20 and the second binding rod 30 from each other by relatively moving the first binding rod 20 and the second binding rod 30, which are to be latched, in a direction crossing turning directions of the first binding rod 20 and the second binding rod 30, in other words, a longitudinal direction of the axis portion 16.

The first binding rod 20 is composed of a semicircular-arc half rod 20A in such a manner as to be a substantially annular binding rod when closed, the second binding rod 30 is composed of a semicircular-arc half rod 30A in such a manner as to be a substantially annular binding rod when closed, and the first binding rod 20 and the second binding rod 30 are so formed as to oppose each other.

Moreover, the binding rod latching portions 22 and 32 are formed at tips of the half rod 20A and the half rod 30A, in other words, at the top portions of the first binding rod 20 and the second binding rod 30 in such a manner as to penetrate through the binding hole 112 previously punched in the leaf 110 to thereby bind the leaf 110.

The half rod 20A composing the first binding rod 20 and the half rod 30A composing the second binding rod 30 are coupled together into a substantially annular form by latching the binding rod latching portion 22 of the first binding rod of the half rod 20A and the binding rod latching portion 32 of the second binding rod of the half rod 30A.

Moreover, in opening the binding rod portion 12, the first binding rod 20 and the second binding rod 30 are configured such that the latched binding rod latching portion 22 of the first binding rod and binding rod latching portion 32 of the second binding rod can be detached from each other by twisting the first binding rod latching portion 22 and the second binding rod latching portion 32 with fingers.

A first binding rod projection 24 at a tip composing the binding rod latching portion 22 of the first binding rod formed at the tip of the half rod 20A composing the first binding rod 20 and a first binding rod recess 26 continuing to this first binding rod projection 24, and a second binding rod projection 34 at a tip composing the binding rod latching portion 32 of the second binding rod formed at the tip of the half rod 30A composing the second binding rod 30 and a second binding rod recess 36 continuing to the second binding rod projection 34 are formed to project or be recessed in opposite directions so that the first binding rod 20 and the second binding rod 30 engage with each other when closed.

Specifically, the first binding rod projection 24 composing the binding rod latching portion 22 of the first binding rod formed at the tip of the half rod 20A composing the first binding rod 20 projects to the near side. Moreover, the first binding rod recess 26 continuing to the first binding rod projection 24 is recessed to the far side. The second binding rod projection 34 composing the binding rod latching portion 32 of the second binding rod formed at the tip of the half rod 30A projects to the far side. Moreover, the second binding rod recess 36 continuing to this second binding rod projection 34 at the tip is recessed to the near side.

The first binding rod projection 24 and the first binding rod recess 26 and the second binding rod projection 34 and the second binding rod recess 36 are so formed as to project or be recessed in the opposite directions so that the first binding rod 20 and the second binding rod 30 engage with each other when closed.

The first binding rod projection 24 composing the binding rod latching portion 22 of the first binding rod of the half rod 20A and the binding rod projection 34 of the second binding rod composing the second binding rod latching portion 32 of the half rod 30A are so provided as to project in the opposite directions.

In addition, the first binding rod recess 26 composing the binding rod latching portion 22 of the first binding rod of the half rod 20A and the second binding rod recess 36 composing the binding rod latching portion 32 of the second binding rod of the half rod 30A are so formed as to be recessed in the opposite directions.

The binding rod latching portion 22 of the first binding rod and the binding rod latching portion 32 of the second binding rod have a disengagement preventing portion 28 and a disengagement preventing portion 38 so formed as to extend in the direction crossing the turning directions of the first binding rod 20 and the second binding rod 30 so that the binding rod latching portion 22 of the first binding rod and the binding rod latching portion 32 of the second binding rod do not disengage from each other in the turning directions of the first binding rod 20 and the second binding rod 30 and the direction crossing the turning directions.

The disengagement preventing portion 28 has: a hooked nose latching projection 28*a* projecting to the near side on a top portion side; and a latching recess 28*b* recessed to the far side on the base portion 20*a* side, and the latching recess 28*b* is formed on the base portion 20*a* side continuously from the latching projection 28*a* on a free end side.

The disengagement preventing portion 38 has: a hooked nose latching projection 38*a* projecting to the far side on a top portion side; and a latching recess 38*b* recessed to the near side on the base portion 30*a* side, and the latching recess 38*b* is formed on the base portion 30*a* side continuously from the latching projection 38*a* on a free end side.

When the first binding rod 20 and the second binding rod 30 are closed, the latching projection 28*a* of the disengagement preventing portion 28 is fitted into the latching recess 38*b* of the disengagement preventing portion 38, the latching projection 38*a* of the disengagement preventing portion 38 is fitted into the latching recess 28*b* of the disengagement preventing portion 28, and the latching projection 28*a* and the latching projection 38*a* hit each other when the first binding rod 20 and the second binding rod 30 are pulled in the turning directions.

The disengagement preventing portion 28 of the binding rod latching portion 22 of the first binding rod projects to an upper portion of the binding rod latching portion 32 of the second binding rod to prevent the second binding rod 30 from moving upwardly due to impact or the like when the binding rod latching portion 22 of the first binding rod and the binding rod latching portion 32 of the second binding rod engage with each other.

The disengagement preventing portion 38 of the binding rod latching portion 32 of the second binding rod projects to an upper portion of the binding rod latching portion 22 of the first binding rod to prevent the first binding rod 20 from moving upwardly due to impact or the like when the binding rod latching portion 22 of the first binding rod and the binding rod latching portion 32 of the second binding rod engage with each other.

As described above, in this embodiment, by twisting the top portions of the first binding rod 20 and the second binding rod 30 with fingers, the first binding rod 20 of the first binding device member 18A can be moved to the far side and the second binding rod 30 of the second binding device member 18B can be moved to the near side to undo the engagement between the binding rod latching portion 22 of the first binding rod of the half rod 20A of the first binding rod 20 and the binding rod latching portion 32 of the second binding rod of the half rod 30A of the second binding rod 30.

Furthermore, the latching projection 28*a* of the disengagement preventing portion 28 and the latching projection 38*a* of the disengagement preventing portion 38 have inclined surfaces gently formed from the free ends in such a manner as to fit into the latching recess 38*b* and the latching recess 28*b* while hitting and sliding on them upon closing.

The first coupling portion 50 of the first binding device member 18A composing the coupling portion 14 includes: a first coupling portion opposing portion 56 as a region where the first coupling portion 50 and the second coupling portion 60 face each other; a first coupling portion outer portion 52 which opposes the first coupling portion opposing portion 56 and at which the first binding rod 20 is provided in a projecting manner; and a first coupling portion lower portion 58 which is a surface crossing the first coupling portion opposing portion 56 and the first coupling portion outer portion 52 between the first coupling portion opposing portion 56 and the first coupling portion outer portion 52 and to which the axis portion 16 is provided continuously.

The second coupling portion 60 of the second binding device member 18B composing the coupling portion 14 includes: a second coupling portion opposing portion 66 as a region where the first coupling portion 50 and the second coupling portion 60 face each other; a second coupling portion outer portion 62 which opposes the second coupling portion opposing portion 66 and at which the second binding rod 30 is provided in a projecting manner; and a second coupling portion lower portion 68 which is a surface crossing the second coupling portion opposing portion 66 and the second coupling portion outer portion 62 between the second coupling portion opposing portion 66 and the second coupling portion outer portion 62 and to which the axis portion 16 is provided continuously.

In this embodiment, the first coupling portion 50 and the second coupling portion 60 have a substantially quadrangular prism shape.

Moreover, the first coupling portion opposing portion 56 and the second coupling portion opposing portion 66 are planes orthogonal to the turning directions and extending perpendicularly, in other words, in the height direction when the binding device 10 is closed. The first coupling portion opposing portion 56 and the second coupling portion opposing portion 66 are so formed as to make close contact with each other when the binding device 10 is closed, as shown in FIGS. 9 and 10.

The coupling portions 14 have an aperture angle restricting portion 70 and an aperture angle restricting portion 72 formed on their side surfaces for restricting an aperture angle of the first binding rod 20 and the second binding rod 30 at an angle, for example, approximately 60 to 70 degrees, which permits easy insertion of the leaf 110.

The aperture angle restricting portion 70 of the first binding device member 18A is, when viewing a cross-section thereof, a substantially semicircular-arc shape formed continuously to a first receiving portion 80 of the first coupling portion lower portion 58 of the first coupling portion 50, and includes a contact surface 70*a* extending downwardly from the first coupling portion lower portion 58. On the other hand, the aperture angle restricting portion 72 of the second binding device member 18B has in cross-section a substantially semicircular-arc shape formed continuously to a second receiving portion 90 of the second coupling portion lower portion 68 of the second coupling portion 60, and includes a contact surface 72*a* extending downwardly from the second coupling portion lower portion 68.

Moreover, when the binding rod portion 12 is closed, the contact surface 70*a* of the aperture angle restricting portion 70 and the contact surface 72*a* of the aperture angle restricting portion 72 are inclined surfaces opposing each other with an aperture of approximately 70 degrees, as shown in FIG. 9. When the binding rod portion 12 is opened, the contact surface 70*a* of the aperture angle restricting portion 70 and the contact surface 72*a* of the aperture angle restricting portion 72 make contact with each other, restricting the aperture angle of the half rod 10A and the half rod 30A at the angle which permits the easy insertion of the leaf 110, as shown in FIG. 15.

The axis portion 16 includes a shaft portion 100 and receiving portions for the shaft portion 100.

The receiving portions are composed of the first receiving portions 80 each provided continuously to the first coupling portion 50 and the second receiving portions 90 each provided continuously to the second coupling portion 60. The shaft portion 100 extends continuously from the far side to the near side along the longitudinal direction of the coupling portions 14, and couples together the first binding device member and the second binding device member.

The first receiving portion 80 and the second receiving portion 90 are provided continuously to the binding rod portion 12 and/or the coupling portions 14, and have aperture portions (aperture portion 84 of the first receiving portion 80 and aperture portion 94 of the second receiving portion 90) formed on their side surfaces for filling the shaft portion 100 therein, and are configured in such a manner as to serve as a rotation center upon closing with the tips of the half rod 20A and the half rod 30A brought into contact with each other and upon separation of the tips of the half rod 20A and the half rod 30A from each other so that the leaf 110 bound at the first binding rods 20 and the second binding rod 30 can be flipped along the first binding rod 20 and the second binding rods 30 and then flipped over through 360 degrees.

The first receiving portion 80 and the second receiving portion 90 are formed intermittently in the longitudinal direction of the coupling portions 14, and formed in such a manner as that the first receiving portion 80 and the second receiving portion 90 relatively move in the longitudinal direction when the half rod 20A and the half rod 30A turn with respect to the shaft portion 100 as a center and also the first binding rod 20 and the second binding rod 30 are opened/closed.

The shaft portion 100 is a rod-like metal bar of a circular shape in cross section. In correspondence therewith, the first receiving portion 80 and the second receiving portion 90 are arc-shaped as a whole, and the shaft portion 100 is filled in a circular-arc portion 86 and a circular-arc portion 96 inside the first receiving portion 80 and the second receiving portion 90, and to outer upper portions thereof, the coupling portions 14 are provided continuously in such a manner as to protrude in directions opposite to directions in which the half rod 20A and the half rod 30A protrude.

In this embodiment, the shaft portion 100, the first receiving portion 80, and the second receiving portion 90 are different members. The first receiving portion 80 is integrally formed with the first binding device member 18A by using synthetic resin, and the second receiving portion 90 is integrally formed with the second binding device member 18B by using synthetic resin.

Moreover, the shaft portion 100 is so formed as to extend from the first receiving portion 80 on the furthest side of the first binding device member 18A to the second receiving portion 90 on the nearest side of the second binding device member 18B.

A first housing portion 82 is intermittently formed between adjacent first receiving portions 80 when the shaft portion 100 is filled, and a second housing portion 92 is intermittently formed between adjacent second receiving portions 90 when the shaft portion 100 is filled.

Moreover, when the first binding rods 20 and the second binding rods 30 are closed, on an axis line of the axis portion 16, the first binding device member 18A has the first housing portions 82 housing the second receiving portions 90 of the second binding device member 18B and the second binding device member 18B has the second housing portions 92 housing the first receiving portions 80 of the first binding device member 18A. The first receiving portions 80 and the second receiving portions 90 are aligned with an appropriate space between each of the first receiving portions 80 of the first binding device member 18A and the second receiving portion 90 of the second binding device member 18B adjacent thereto and between each of the second receiving portions 90 of the second binding device member 18B and the first receiving portion 80 of the first binding device member 18A adjacent thereto. The appropriate space between each of the first receiving portions 80 of the first binding device member 18A and the second receiving portions 90 of the second binding device member 18B adjacent thereto and between each of the second receiving portions 90 of the second binding device member 18B and the first receiving portions 80 of the first binding device member 18A adjacent thereto refers to as a length required for relatively moving the first binding rod 20 and the second binding rod 30 in the longitudinal direction of the coupling portions 14, in other words, to the near side and the far side to thereby disengage the first binding rod latching portion 22 and the second binding rod latching portion 32.

In addition, the first binding device member 18A and the second binding device member 18B are slidably mounted at the shaft portion 100 so that the half rod 20A and the half rod 30A relatively move upon opening/closing of the first binding rod 20 and the second binding rod 30.

In this embodiment, the first binding rod 20 of the first binding device member 18A is moved to the far side and the second binding rod 30 of the second binding device member 18B is moved to the near side to open the closed first binding rod 20 and second binding rod 30.

In this embodiment, the aperture portion 84 of the first receiving portion 80 on the far side of the first binding device member 18A is covered on the far side. On the other hand, the aperture portion 94 of the second receiving portion 90 on the near side of the second binding device member 18B is covered on the near side. Accordingly, the first receiving portion 80 on the far side prevents a far-side end of the shaft portion 100 from coming off, and the second receiving portion 90 on the near side prevents a near side end of the shaft portion 100 from coming off.

An outer periphery portion of the base portion 20*a* of the half rod 20A and an outer periphery portion of the base portion 30*a* of the half rod 30A are formed with their lower portions located at the same positions as those of the lower portions of the coupling portion 14. An outer side of the first receiving portion 80 and an outer side of the second receiving portion 90 of the axis portion 16 are formed with their upper portions located at the same positions as those of the lower portions of the coupling portions 14.

In this embodiment, the first receiving portion 80 of the axis portion 16 has the aperture portion 84 making contact with the outer periphery portion of the half rod 20A, and the second receiving portion 90 of the axis portion 16 has the aperture portion 94 making contact with the outer periphery portion of the half rod 30A. The first coupling portion 50 has a height between an inner periphery portion of the half rod 20A and the aperture portion 84 of the first receiving portion 80, and the second coupling portion 60 has a height between an inner periphery portion of the half rod 30A and the aperture portion 94 of the second receiving portion 90.

A width of the coupling portion 14 (in a width direction) is equal to or smaller than half a width of the first receiving portion 80 of the axis portion 16 or the second receiving portion 90 of the axis portion 16 (in a width direction). This configuration is provided since if a width obtained by adding together a width of the first coupling portion 50 and a width of the second coupling portion 60 is equal to or smaller than the width of the first receiving portion 80 of the axis portion 16 and the width of the second receiving portion 90 of the axis portion 16, when the leaf 110 is flipped over through 360 degrees and the front side and the reverse side of the leaf 110 are brought into contact with each other with the axis portion 16 sandwiched therebetween, this contact can be made with a relatively small space.

Between the first housing portion 82 of the first binding device member 18A located in the vicinity of a center of the first coupling portion 50 and the second housing portion 92 of the second binding device member 18B located in the vicinity of a center of the second coupling portion 60, a spring member 102 which applies tension (tensile or compressive force) in a longitudinal direction of the shaft portion 100 is fitted in a compressed state. The spring member 102 is formed of a coil spring made by winding a steel wire into a coil form, and the shaft portion 100 is inserted through loops of the tube-shaped coil spring.

Moreover, the spring member 102 has a far-side end making contact with a near-side end of the second receiving portion 90 of the second binding device member 18B and a near-side end making contact with a far-side end of the first receiving portion 80 of the first binding device member 18A. The spring member 102 is so configured as to press down the first binding device member 18A to the near side and to press up the second binding device member 18B to the far side by (uniform) restoring force.

Thus, the spring member 102 operates in a direction engaging the binding rod latching portion 22 of the first binding rod with the binding rod latching portion 32 of the second binding rod when the binding rod portion 12 is closed.

Upon detachment of the latched binding rod latching portion 22 of the first binding rod and binding rod latching portion 32 of the second binding rod from each other by twisting the binding rod latching portion 22 of the first binding rod and the binding rod latching portion 32 of the second binding rod with fingers, the first binding rod 20 of the first binding device member 18A is moved to the far side and the second binding rod 30 of the second binding device member 18B is moved to the near side against spring force of the spring member 102, whereby the closed first binding rod 20 and second binding rod 30 are opened. Furthermore, the first binding rod 20 and the second binding rod 30 can be turned outwardly in the width direction (in other words, the first binding rod 20 can be turned to a left side (front side) and the second binding rod 30 can be turned to a right side (reverse side)) to easily bind or unbind the leaf 110.

The binding device 10 forms a notebook by binding the leaf 110 in such a manner that the binding holes 112 continuously provided at appropriate intervals in a height direction of the leaf 110 are penetrated by the first binding rods 20 and the second binding rods 30, the axis portion 16 is situated on a side of a binding margin side edge 114 extending in the height direction of the leaf 110, and the first binding rods 20 and the second binding rods 30 bridge between the binding holes 112 and the binding margin side edge 114.

The binding device 10 may form a notebook by binding the leaf 110 in such a manner that a length direction of the binding device 10 spread spatially while extending in the width direction of the leaf 110 having the binding holes 112 formed at the edge extending in the width direction.

Figure 17:
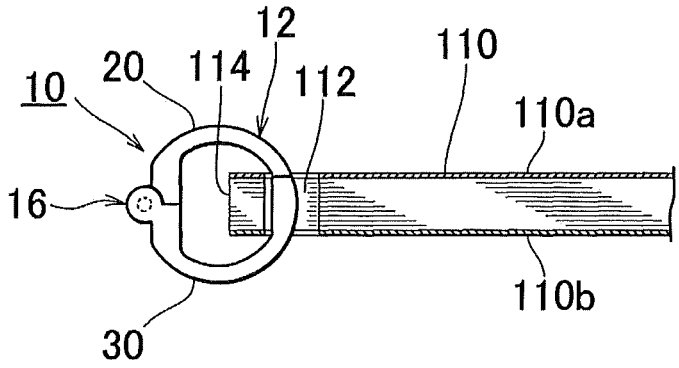
FIG. 17 is a schematic plan view showing how to open leaves of a notebook, where (A) is a view in a closed state, (B) is a view in a half-flipped state, and (C) is a view in a 360-degree-flipped state.
Figure 17:
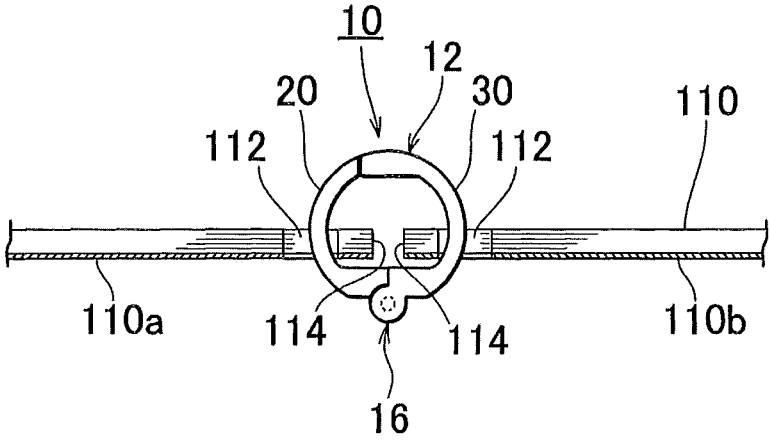
Figure 17:
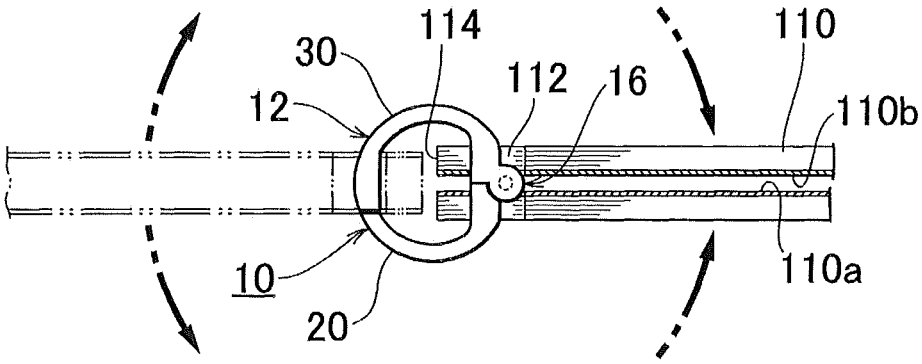

The leaf 110 bound by the binding device 10 can be used for writing or otherwise in such a manner that the leaf 110 is flipped over to the axis portion 16 side and a leaf front side 110*a* and a leaf reverse side 110*b* are brought into contact with each other with the axis portion 16 sandwiched therebetween when the leaves are laid during closing, as shown in FIG. 17.

According to the embodiment of the present invention, the binding rod portions 12 and the coupling portions 14 are formed at each of the first binding device member 18A and the second binding device member 18B in a pair, and the binding rods 20 and 30 composing the binding rod portions 12 are provided at the appropriate intervals in the longitudinal direction of the coupling portions 14 in such a manner as to project from the outer portion or the upper portion of the coupling portions 14 so that the first binding rods 20 on the first binding device member 18A side and the second binding rods 30 on the second binding device member 18B side face each other. Therefore, when the binding rod portions 12 are opened, lowest portions of the binding rod portions 12 are grounded on a surface of, for example, a desk top plate to be thereby easily horizontally stabilized, and also the binding rod portions 12 can be easily opened at an appropriate degree.

According to the embodiment of the present invention, the binding rod portion 12 includes the first binding rod 20 and the second binding rod 30 in the symmetrical form separated to the left and right with respect to the axis portion 16 as the center, and the coupling portion 14 includes the first coupling portion 50 and the second coupling portion 60 in the symmetrical form separated to the left and right with respect to the axis portion 16 as the center. Therefore, the left and right members can be formed with the same die, which makes it easy to manufacture them.

According to the embodiment of the present invention, the coupling portion 14 includes: the mutually facing opposing portions 56 and 66 of the first coupling portion 50 and the second coupling portion 60; the outer portions 52 and 62 which oppose the opposing portions 56 and 66 and from which the binding rods 20 and 30 are provided in such a manner as to project; and the lower portions 58 and 68 which are surfaces crossing the opposing portions 56 and 66 and the outer portion 52 and 62 between the opposing portions 56 and 66 and the outer portions 52 and 62 and to which the axis portion 16 is provided continuously. Therefore, the first coupling portion opposing portion 56 and the second coupling portion opposing portion 66 are planes orthogonal to the turning directions and spatially spreading in such a manner as to extend perpendicularly, in other words, the height direction when the binding device 10 is closed. Forming the first coupling portion opposing portion 56 and the second coupling portion opposing portion 66 in such a manner as to bring them into close contact with each other when the binding device 10 is closed can stably maintain condition of the engagement between the binding rod latching portion 22 of the first binding rod and the binding rod latching portion 32 of the second binding rod when the binding device 10 is closed, which can reduce shrinking action of an annular diameter formed by the first binding rod 20 and the second binding rod 30 composing the binding rod portion 12. Therefore, the binding rod portion 12 composed of plural binding rods 20 and 30 can be opened and closed at once.

According to the embodiment of the present invention, the receiving portions 80 and 90 are formed intermittently in the longitudinal direction of the coupling portions 14, and formed in such a manner that the binding rod portions 12 turn with respect to the shaft portion 100 as the center and relatively move in the longitudinal direction upon opening/closing of the binding rod portions 12.

According to the embodiment of the present invention, the shaft portion 100 is of a circular rod shape in cross section, the receiving portions 80 and 90 are arc-shaped as a whole, the shaft portion 100 is filled in the arc portions therein, and to the outer upper portions thereof, the coupling portions 14 are provided continuously in such a manner as to protrude in the directions opposite to the directions in which the binding rods 20 and 30 protrude. Therefore, the binding rod portions 12 composed of the plurality of binding rods 20 and 30 can be opened/closed at once, the lowest portions of the binding rod portions 12 are grounded on the surface of, for example, the desk top plate to be thereby easily horizontally stabilized, and the binding rod portions 12 can easily be opened at the appropriate degree.

According to the embodiment of the present invention, the base portions 20*a* and 30*a* of the binding rods 20 and 30 are formed with their lower portions located at the same positions as those of the lower portions of the coupling portions 14, and the receiving portions 80 and 90 of the axis portion 16 are formed with their upper portions located at the same positions as those of the lower portions of the coupling portions 14. Therefore, when the binding rod portions 12 are opened, the lowest portions of the binding rod portions 12 are grounded on the surface of, for example, the desk top plate to be thereby easily horizontally stabilized, and the binding rod portions 12 can easily be opened at the appropriate degree.

According to the embodiment of the present invention, the width of the coupling portion 14 is equal to or smaller than half the width of the axis portion 16. Therefore, it does not extend beyond the width of the axis portion 16, and when the leaf 110 is flipped along the binding rods 20 and 30 and opened through 360 degrees, the space between the front side and the reverse side of the leaf 110 is small, thus providing relative flatness, which also makes writing easier.

According to the embodiment of the present invention, the receiving portions 80 and 90 of the axis portion 16 have the aperture portions 84 and 94 of the receiving portions 80 and 90 making contact with the outer periphery portions of the binding rods 20 and 30, and the coupling portions 14 have height from the inner periphery portions of the binding rods 20 and 30 to the aperture portions 84 and 94 of the receiving portions 80 and 90. Therefore, when the leaf 110 is flipped along the binding rods 20 and 30 and opened through 360 degrees, the space between the leaf front side 110*a* and the leaf reverse side 110*b* is small, thus providing relative flatness, which also makes writing easier.

According to the embodiment of the present invention, the binding rod latching portions 22 and 32, in order to be engaged or disengaged in the turning directions of the binding rods 20 and 30, are so configured as to engage the projection 24 and the recess 26 of the first binding rod 20 and the recess 36 and the projection 34 of the second binding rod 30, and the binding rod latching portions 22 and 32, in order not to be disengaged in the turning directions of the binding rods 20 and 30 and the direction crossing the turning directions when the binding rod portions 12 are closed, have the disengagement preventing portions 28 and 38 so formed as to extend in the direction crossing the turning directions of the binding rods 20 and 30. Therefore, the binding rod latching portions 22 and 32 of the closed binding rods are hard to be disengaged in the turning directions of the binding rods 20 and 30 and the direction crossing the turning directions.

The binding device 10 of the embodiment of the present invention can form a notebook bound with the binding rod portions 12 of the binding device 10 penetrated through the binding holes 112 of the leaf 110, and can form a file, a binder, or the like by being fixed on the cover including the front cover, the back cover, and a spine.

The present invention is not limited to the embodiment described above and thus various modifications can be made based on the spirits of the present invention.

Figure 18:
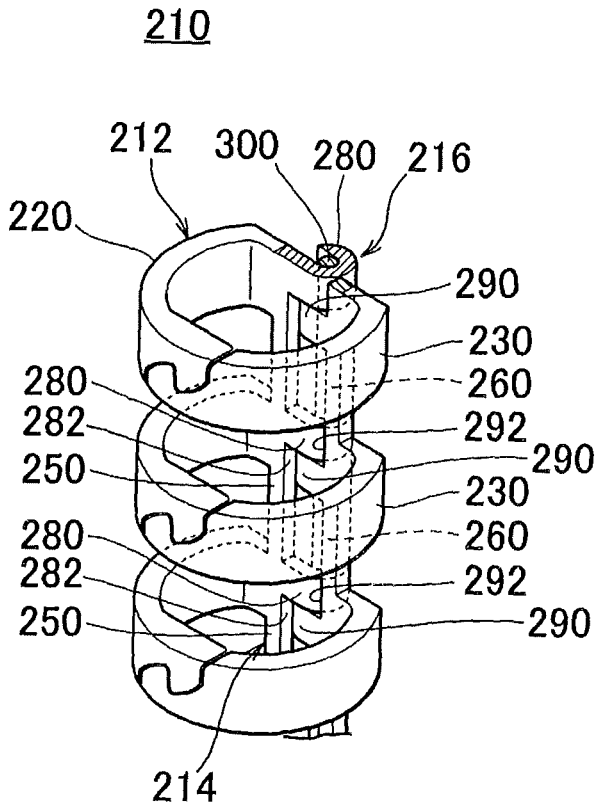
FIG. 18 is a schematic perspective view of a modified example.

FIG. 18 is a schematic perspective view of a binding device as a modified example of the embodiment described above.

This binding device 210 includes: a plurality of binding rod portions 212, coupling portions 214 for coupling the binding rod portions 212, and a shaft portion 300 serving as a center upon opening/closing of first binding rods 220 and second binding rods 230 composing the binding rod portions 212.

The binding rods composing the binding rod portions 212 are respectively provided at pairs of a first coupling portion 250 and a second coupling portion 260 composing the coupling portions 214 at appropriate intervals in a longitudinal direction thereof in such a manner as to project from outer portions or upper portions of the coupling portions 214 so that pairs of the first binding rod 220 and the second binding rod 230 face each other.

The coupling portions 214 include their lower portions to which the axis portion 216 is provided continuously at a position close to base portions of the first binding rod 220 and the second binding rod 230 so that when the leaf 110 bound at the binding rod portions 212 is flipped along the first binding rods 20 and the second binding rods 30 and flipped over through 360 degrees for closing, the front side and the reverse side of the leaf 110 located at the both ends can make contact with each other with the axis portion 216 sandwiched therebetween.

The axis portion 216 includes a first receiving portion 280 and a first housing portion 282 and a second receiving portion 290 and a second housing portion 292, extends in the longitudinal direction of the coupling portions 214 to couple pairs of the first coupling portion 250 and the second coupling portion 260, and is so configured to serve as a rotation center upon closing with tips of the first binding rods 220 and the second binding rods 230 brought into contact with each other and upon separation of the tips of the first binding rods 220 and the second binding rods 230 from each other so that the leaf 110 bound at the binding rod portions 212 can be flipped along the binding rods and flipped over through 360 degrees.

The base portions of the first binding rod 220 and the second binding rod 230 are formed with lower portions of their outer peripheral portions located at the same positions as those of the lower portions of the first coupling portion 250 and the second coupling portion 260. The first receiving portion 280 and the second receiving portion 290 composing the axis portion 216 are formed with their upper portions located at the same positions as those of the lower portions of the first coupling portion 250 and the second coupling portion 260.

The spring member 102 may be configured in the following manner.

Figure 19:
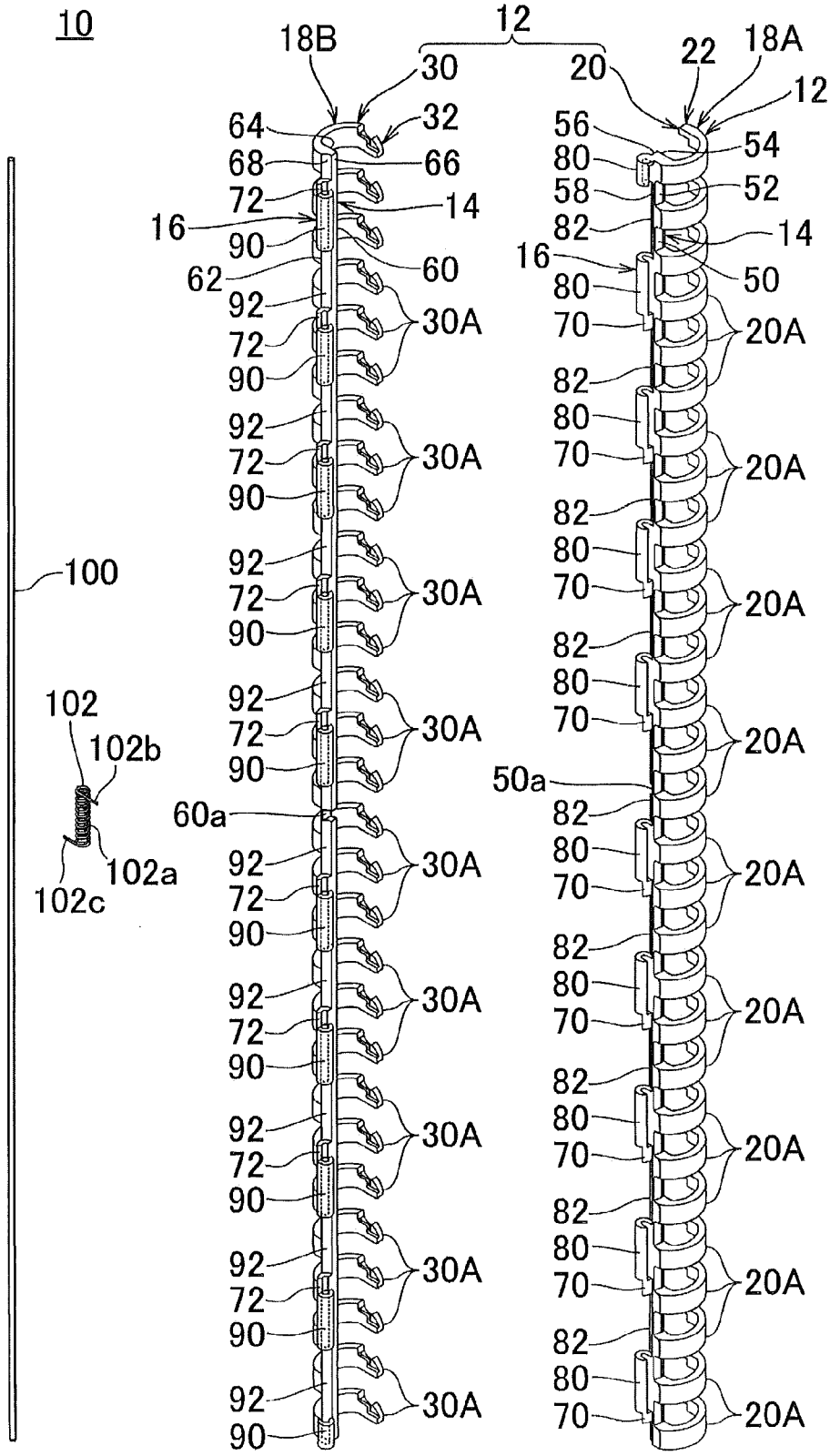
FIG. 19 is a schematic perspective view of a binding device of the modified example in a disassembled state.
Figure 20:
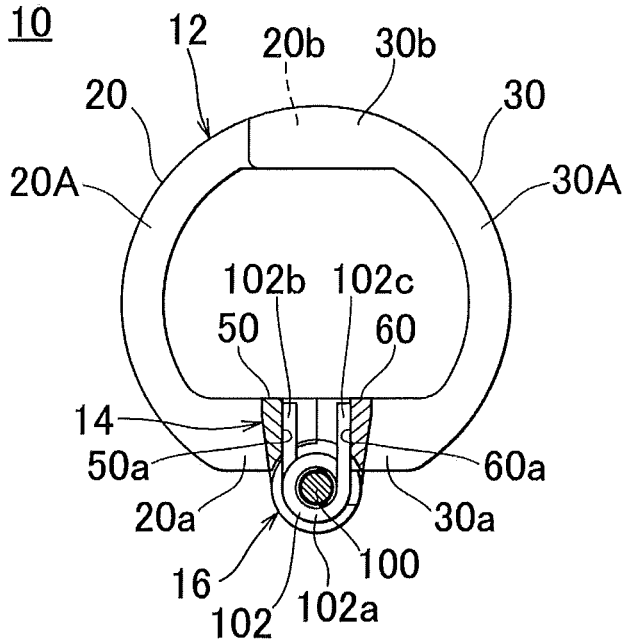
FIG. 20 is a schematic cross-sectional view of the binding device shown in FIG. 19, where (A) is a schematic cross-sectional view in a closed state and (B) is a schematic cross-sectional view in an opened state.
Figure 20:
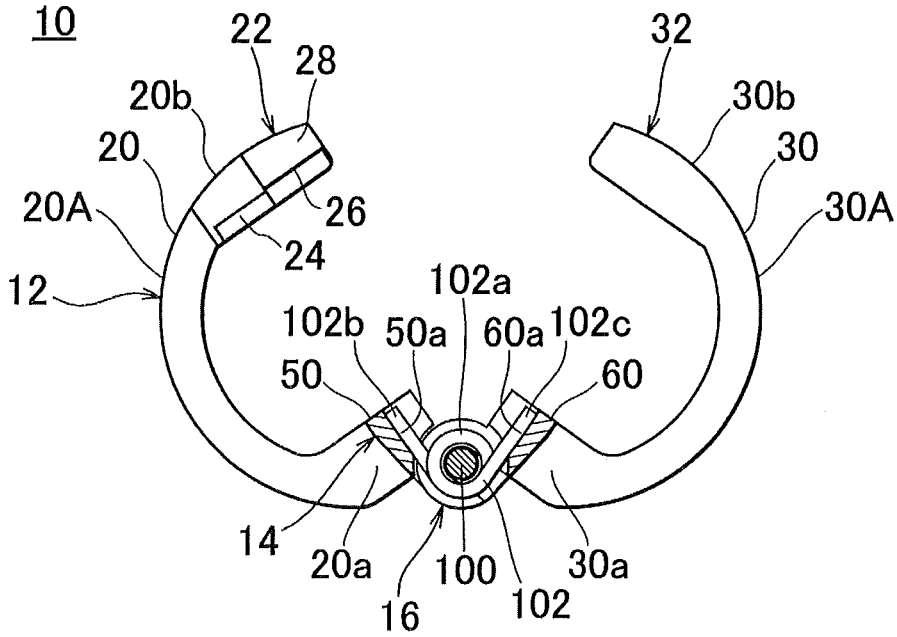
Figure 21:
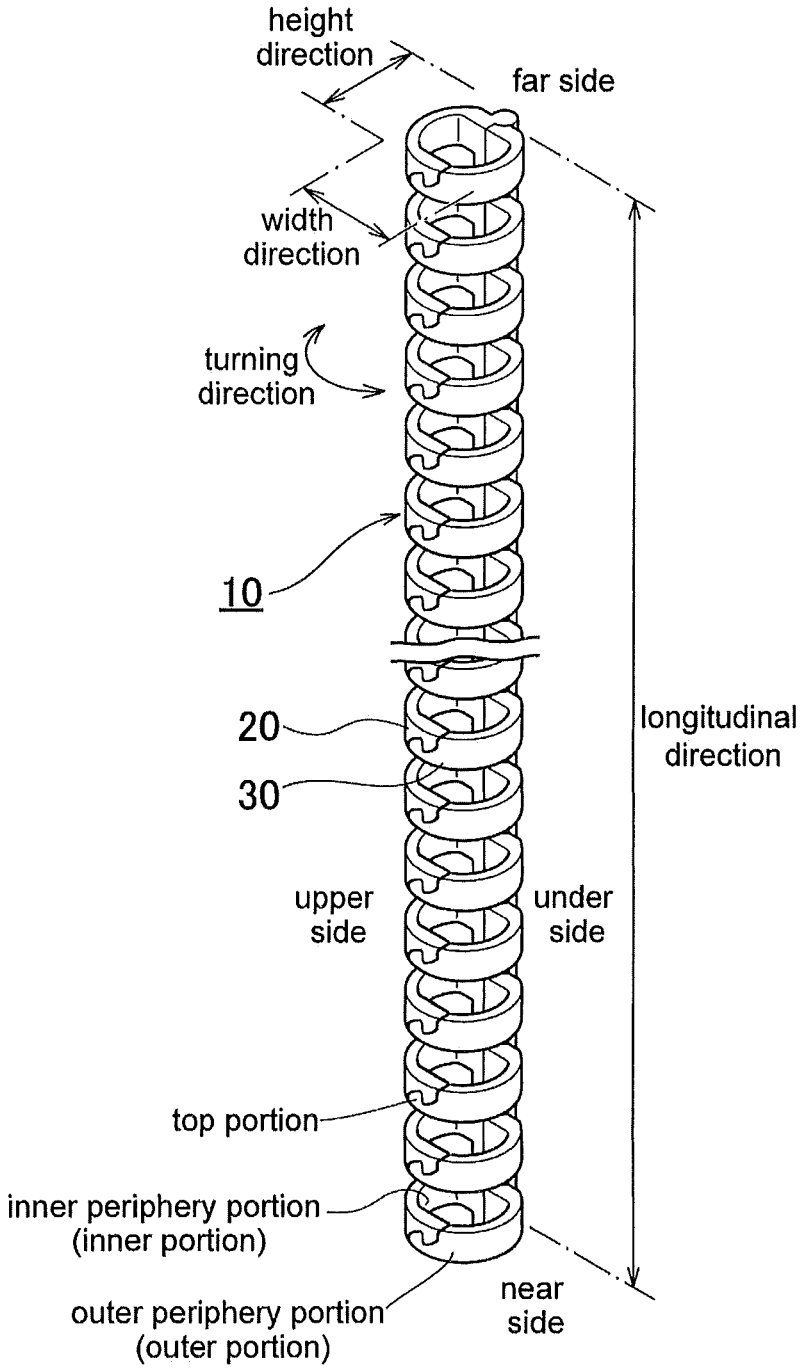
FIG. 21 is an illustration diagram of the binding device.
Figure 22:
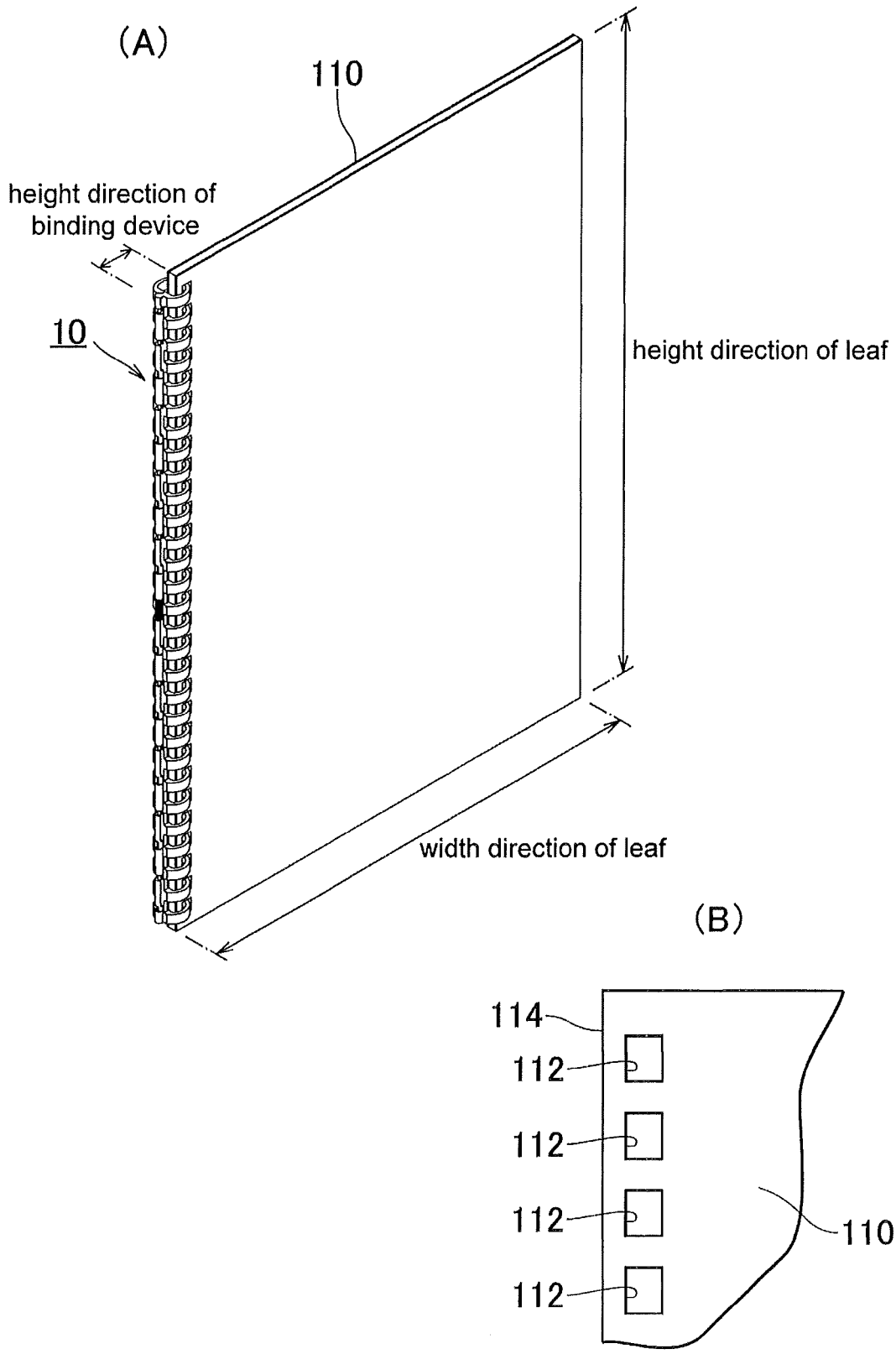
FIG. 22 is an illustration diagram of a notebook, where (A) is an overall view and (B) is a view of a leaf.

FIG. 19 is a schematic perspective view of the binding device of the modified example in a disassembled state. FIG. 20 is a schematic cross-sectional view of the binding device of FIG. 19, where (A) is a schematic cross-sectional view in a closed state and (B) is a schematic cross-sectional view in an opened state.

The spring member 102 shown in FIG. 19 is formed of a twisted coil spring and is continuously provided with: a coil portion 102*a*; and a first fixing tip portion 102*b* and a second fixing tip portion 102*c* of linear shapes extending from both ends of the coil portion 102*a* in a direction orthogonal to or crossing a central axis of the coil portion 102*a*. In an original condition in which no torsional moment is generated, the first fixing tip portion 102*b* and the second fixing tip portion 102*c* are projected circumferentially.

Moreover, a support portion 50*a* and a support portion 60*a* are formed at the coupling portions 14 so as to support the tip portions extending from the both ends of the coil portion 102*a* of the spring member 102.

The fixing tip portions extending from the both ends of the coil portion 102*a* of the spring member 102 are supported in such a manner as to be latched by the support portion 50*a* formed at the first coupling portion 50 of the first binding device member 18A and the support portion 60*a* of the second coupling portion 60 of the second binding device member 18B which support portion 60*a* opposes the support portion 50*a*.

In other words, the first fixing tip portion 102*b* on one hand is supported by the support portion 50*a* of the first coupling portion 50, and the second fixing tip portion 102*c* on the other hand is supported by the support portion 60*a* of the second coupling portion 60 in such a manner as to face the first fixing tip portion 102*b*.

Although the first fixing tip portion 102*b* on one hand and the second fixing tip portion 102*c* on the other hand were originally in an opened state, when the first binding rods 20 and the second binding rods 30 are in a closed state, the first fixing tip portion 102*b* and the second fixing tip portion 102*c* substantially parallelly approaching each other from a place where the first binding rod 20 and the second binding rod 30 were originally in the opened state are supported by the support portion 50*a* and the support portion 60*a* of the coupling portion 14. In other words, the spring member 102 turns into a twisted state with the first fixing tip portion 102*b* latched by the support portion 50*a* of the first coupling portion 50 and the second fixing tip portion 102*c* latched by the support portion 60*a* of the second coupling portion 60.

Moreover, the spring member 102 has a far-side end making contact with a near-side end of the second receiving portion 90 of the second binding device member 18B and a near-side end making contact with a far-side end of the first receiving portion 80 of the first binding device member 18A, and is so configured as to press down the first binding device member 18A to the near side and to press up the second binding device member 18B to the far side by (uniform) restoring force.

Thus, the spring member 102 operates in a direction engaging the binding rod latching portion 22 of the first binding rod with the binding rod latching portion 32 of the second binding rod when the binding rod portion 12 is closed.

Upon detachment of the latched binding rod latching portion 22 of the first binding rod and binding rod latching portion 32 of the second binding rod from each other by twisting the binding rod latching portion 22 of the first binding rod and the binding rod latching portion 32 of the second binding rod with fingers, the first binding rod 20 of the first binding device member 18A is moved to the far side and the second binding rod 30 of the second binding device member 18B is moved to the near side against spring force of the spring member 102, whereby the closed first binding rod 20 and second binding rod 30 are opened.

When the binding rod latching portion 22 of the first binding rod 20 is detached by fingers, the first coupling portion 50 and the second coupling portion 60 turns in the turning directions by action of force with which the spring member 102 restores its original state, in other words, action of force with which the first fixing tip portion 102*b* on one hand and the second fixing tip portion 102*c* on the other hand turn in the turning directions to open the binding rod portion 12.

As described above, in this embodiment, when the engagement between the first binding rod latching portion 22 of the first binding rod 20 and the second binding rod latching portion 32 of the second binding rod 30 have been released, by action of force with which the first fixing tip portion 102*b* on one hand and the second fixing tip portion 102*c* on the other hand are circumferentially separated from each other, the first binding rod 20 and the first coupling portion 50, and the second binding rod 30 and the second coupling portion 60 turn into an opened state.

Furthermore, described in the embodiment and the modified example is that the first binding rod 20 and the second binding rod 30 release the engagement between the latched binding rod latching portion 22 of the first binding rod and binding rod latching portion 32 of the second binding rod by twisting the binding rod latching portion 22 of the first binding rod and the binding rod latching portion 32 of the second binding rod with fingers. However, it is needless to say that disengaging the binding rod latching portion 22 of the first binding rod and the binding rod latching portion 32 of the second binding rod by a means other than twisting with the fingers is also included in the binding device according to the present invention.

The binding device 10 according to the present invention can be used in such a manner as to be fixed inside a spine region of a cover composing a file, a binder, or the like or may be used independently.

The invention claimed is:

1. A binding device comprising:

a plurality of binding rod portions that include first binding rods and second binding rods, the first and second binding rods being movable between being opened and closed, the first and second binding rods forming pairs of first and second binding rods that each includes one of the first binding rod opposing a respective one of the second binding rods, the first and second binding rods forming a substantially annular binding rod when the first and second binding rods are closed, the first and second binding rods respectively including first binding rod latching portions and second binding rod latching portions to latch and engage the first and second binding rods together by latching tips of the first binding rod latching portions with tips of the second binding rod latching portions when the first and second binding rods are closed;

a first coupling portion and a second coupling portion for coupling the first and second binding rods;

an axis portion serving as a rotation center of the first and second binding rods during opening or closing of the first and second binding rods, the axis portion including a shaft portion and receiving portions, the receiving portions holding the shaft portion therein and coupling the first and second coupling portions together, the shaft portion extending along a coupling longitudinal direction of the first and second coupling portions, wherein the receiving portions have first receiving portions and second receiving portions provided in the first coupling portion and the second coupling portion respectively;

a first housing portion formed between the first receiving portions; and a second housing portion formed between the second receiving portions, wherein the first coupling portion and the second coupling portion are separated from each other along a direction that is not parallel to a longitudinal axis of the axis portion, the axis portion being at a center point between the first and second coupling portions, the pairs of the first and second binding rods are provided at the first and second coupling portions at intervals in the coupling longitudinal direction, the first and second binding rods projecting from the first and second coupling portions so that each pair of the first and second binding rods forms a circle when the first and second binding rods are closed, the tips of the first and second binding rod latching portions being at free ends of the first and second binding rods on a side opposite to base portions of the first and second binding rods that are provided continuously at the first and second coupling portions, the first and second binding rod latching portions each have disengagement preventing portions that extend in a direction crossing turning directions of the first and second binding rods so that when the first and second binding rods are closed, the first and second binding rod latching portions do not disengage from each other in the turning directions of the first and second binding rods and the direction crossing the turning directions, the first binding rod is displaced from and opposes the second binding rod in the coupling longitudinal direction, and is formed so that the first binding rod latching portions are disengageable from the second binding rod latching portions when the first and second binding rods are moved to be opened by disengaging the tips from each other, the first receiving portions and the second receiving portions are aligned along the longitudinal axis of the axis portion so as to house the second receiving portions in the first housing portions and the first receiving portions in the second housing portions when the first and second binding rods are closed, and the first receiving portions and the second receiving portions are aligned so that spaces are formed between adjacent ones of the first and second receiving portions for disengagement of the first and second binding rod latching portions by allowing for relative movement between the first binding rod and the second binding rod in the coupling longitudinal direction in the spaces between the adjacent ones of the first and second receiving portions, the first and second receiving portions are formed so as to turn with respect to the shaft portion as a center and relatively move the first and second binding rods along the longitudinal axis of the axis portion when the first and second binding rods are opened or closed.

2. The binding device according to claim 1, wherein the coupling portions have aperture angle restricting portions formed on side surfaces thereof for restricting an aperture angle of the first and second binding rods at an angle which permits easy insertion of a leaf.

3. A binding device comprising:

a plurality of binding rod portions that includes first binding rods and second binding rods, the first and second binding rods being configured to be moveable so as to be opened or closed, the first and second binding rods forming pairs of first and second binding rods that each includes one of the first binding rods opposing a respective one of the second binding rods, the first and second binding rods forming a substantially annular binding rod when the first and second binding rods are closed, the first and second binding rods respectively including first binding rod latching portions and second binding rod latching portions, tips of the first and second binding rod latching portions being configured to engage each other and latch the first and second binding rods together by engaging the first binding rod latching portions with the second binding rod latching portions when the first and second binding rods are closed, and the tips configured to disengage each other when the first and second binding rods are opened;

coupling portions for coupling the first and second binding rods;

an axis portion serving as a rotation center during opening or closing of the first and second binding rods, the axis portion including a shaft portion and receiving portions, the receiving portions holding the shaft portion therein and coupling the coupling portions together, the shaft portion extending along a coupling longitudinal direction of the first and second coupling portions, wherein the receiving portions have first receiving portions and second receiving portions provided in the first coupling portion and the second coupling portion respectively;

a first housing portion formed between the first receiving portions; and second housing portion formed between the second receiving portions, wherein the first and second binding rods face each other at intervals along the coupling longitudinal direction so as to form the substantially annular binding rod when the first and second binding rods are closed, and the first and second binding rods project respectively from pairs of the coupling portions, the axis portion is disposed continuously at a position close to base portions of the first and second binding rods so that an object bounded at the first and second binding rods is flippable along the pairs of first and second binding rods through 360 degrees, and a front side and a reverse side of the object can make contact with each other with the axis portion sandwiched therebetween, the first receiving portions and the second receiving portions are aligned along a longitudinal axis of the shaft portion so as to house the second receiving portions in the first housing portions and the first receiving portions in the second housing portions when the first and second binding rods are closed, and the first receiving portions and the second receiving portions are aligned so that spaces are formed between adjacent ones of the first and second receiving portions for disengaging the first and second binding rod latching portions from each other by allowing for relative movement between the first binding rod and the second binding rod in the coupling longitudinal direction in the spaces between the adjacent ones of the first receiving portions and the second receiving portions, the axis portion is formed so as to turn with respect to the shaft portion as a center and relatively move the pairs of the first and second binding rods along the longitudinal axis of the shaft portion when the first and second binding rods are opened or closed, one of the first binding rods among the pairs of the first and second binding rods is formed in such a manner so as to relatively move in the coupling longitudinal direction and simultaneously disengage the first binding rod latching portion from the respective second binding rod latching portion, the first and second binding rod latching portions including disengagement preventing portions that extend in a direction crossing turning directions of the first and second binding rods so that the first and second binding rod latching portions do not disengage from each other in the turning directions of the binding rods and the direction crossing the turning directions when the first and second binding rods are closed.

4. The binding device according to claim 3, further comprising a spring member applying tensile or compressive force in a longitudinal direction of the shaft portion and fitted in a compressed state between the first housing portion and the one of the second receiving portions or between the second housing portion and one of the first receiving portions.

5. The binding device according to claim 4, wherein the coupling portions have aperture angle restricting portions formed on side surfaces thereof for restricting an aperture angle of the first and second binding rods at an angle which permits easy insertion of the object.

6. The binding device according to claim 3, wherein the coupling portions have aperture angle restricting portions formed on side surfaces thereof for restricting an aperture angle of the first and second binding rods at an angle which permits easy insertion of the object.

* * * * *